US010371041B2

(12) United States Patent
Toyama et al.

(10) Patent No.: US 10,371,041 B2
(45) Date of Patent: Aug. 6, 2019

(54) COOLING DEVICE FOR INTERNAL COMBUSTION ENGINE OF VEHICLE AND CONTROL METHOD THEREOF

(71) Applicant: HITACHI AUTOMOTIVE SYSTEMS, LTD., Hitachinaka-shi, Ibaraki (JP)

(72) Inventors: Yuichi Toyama, Isesaki (JP); Atsushi Murai, Isesaki (JP); Shigeyuki Sakaguchi, Isesaki (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 0 days.

(21) Appl. No.: 15/759,918

(22) PCT Filed: Dec. 13, 2016

(86) PCT No.: PCT/JP2016/086995

§ 371 (c)(1),
(2) Date: Mar. 14, 2018

(87) PCT Pub. No.: WO2017/104636

PCT Pub. Date: Jun. 22, 2017

(65) Prior Publication Data

US 2018/0245503 A1 Aug. 30, 2018

(30) Foreign Application Priority Data

Dec. 17, 2015 (JP) ..... 2015-246108

(51) Int. Cl.
*F01P 7/16* (2006.01)
*F01P 3/02* (2006.01)
(Continued)

(52) U.S. Cl.
CPC ..... *F01P 7/16* (2013.01); *F01P 3/02* (2013.01); *F01P 5/10* (2013.01); *F01P 7/048* (2013.01);
(Continued)

(58) Field of Classification Search
CPC ..... F01P 3/02; F01P 3/20; F01P 2003/024; F01P 5/10; F01P 7/04; F01P 7/048;
(Continued)

(56) References Cited

U.S. PATENT DOCUMENTS 6,668,764 B1 * 12/2003 Henderson ..... F01P 7/167 123/41.1
8,443,775 B2 * 5/2013 Ktami ..... F01P 7/165 123/142.5 E
(Continued)

FOREIGN PATENT DOCUMENTS

DE 26 31 121 A1 1/1978
DE 11 2014 006 486 10/2017
(Continued)

OTHER PUBLICATIONS

Japanese Office Action dated May 22, 2018 as issued in corresponding Japanese Application No. 2015-246108 and its partial English translation thereof.
(Continued)

*Primary Examiner* — John M Zaleskas
(74) *Attorney, Agent, or Firm* — Foley & Lardner LLP

(57) ABSTRACT

A cooling device for an internal combustion engine of a vehicle according to the claimed invention includes: an electric water pump; a first path including a cooling water passage in a cylinder head and extending through a heater core for air heating and a radiator; and a second path bypassing the heater core and radiator. When the internal combustion engine is automatically stopped while the vehicle is stopping, the cooling device causes the electric water pump to operate, and increases the cooling water circulation ratio through the first path while reducing the cooling water circulation ratio through the second path. Thereby, the cooling device improves fuel economy during acceleration at the vehicle start from the automatic stop state
(Continued)

of the internal combustion engine while suppressing the deterioration of the air heating performance during the automatic stop of the internal combustion engine while the vehicle is stopping.

8 Claims, 13 Drawing Sheets

(51) Int. Cl.
*F01P 5/10* (2006.01)
*F01P 7/04* (2006.01)
*F01P 7/14* (2006.01)

(52) U.S. Cl.
CPC ..... *F01P 7/164* (2013.01); *F01P 7/167* (2013.01); *F01P 2003/024* (2013.01); *F01P 2003/028* (2013.01); *F01P 2005/105* (2013.01); *F01P 2007/146* (2013.01); *F01P 2025/40* (2013.01); *F01P 2025/66* (2013.01); *F01P 2060/08* (2013.01); *F01P 2060/16* (2013.01)

(58) Field of Classification Search
CPC ..... F01P 7/14; F01P 7/16; F01P 7/164; F01P 7/165; F01P 2007/146; F01P 2025/40; F01P 2025/64; F01P 2025/66
USPC ..... 123/41.02, 41.08, 41.09, 41.44
See application file for complete search history.

(56) References Cited

U.S. PATENT DOCUMENTS 8,958,933 B2 * 2/2015 Abihana ..... B60W 10/06 701/22
9,816,429 B2 11/2017 Murai et al.
2004/0103862 A1 * 6/2004 Aidnik ..... F01P 7/164 123/41.29
2006/0231640 A1 * 10/2006 Hashimura ..... B60H 1/00492 237/34
2010/0236502 A1 * 9/2010 Watanabe ..... B60K 6/48 123/41.02
2011/0214627 A1 * 9/2011 Nishikawa ..... F01P 7/04 123/41.02
2013/0255603 A1 * 10/2013 Pursifull ..... F01P 11/16 123/41.15
2013/0255605 A1 * 10/2013 Jentz ..... F01P 11/16 123/41.15
2013/0284127 A1 * 10/2013 Goto ..... F01P 11/16 123/41.02
2014/0007824 A1 * 1/2014 Hayashi ..... F01P 7/167 123/41.01
2014/0283765 A1 * 9/2014 Naito ..... F01P 3/12 123/41.09
2015/0377114 A1 * 12/2015 Matsumoto ..... F02F 1/14 123/41.44
2016/0010533 A1 * 1/2016 Matsumoto ..... F01P 3/02 123/41.08
2017/0074153 A1 * 3/2017 Kaneko ..... F01P 7/165
2017/0096930 A1 * 4/2017 Murai ..... F01P 3/02
2017/0107891 A1 * 4/2017 Murai ..... F01P 3/02
2017/0253104 A1 * 9/2017 Amano ..... F01P 3/18
2017/0254255 A1 * 9/2017 Murai ..... F01P 3/20
2017/0292435 A1 * 10/2017 Toyama ..... F01P 11/16
2018/0038267 A1 * 2/2018 Murai ..... F01P 7/16
2018/0080366 A1 * 3/2018 Toyama ..... B60H 1/08
2018/0245504 A1 * 8/2018 Murai ..... F01P 7/16
2018/0266304 A1 * 9/2018 Toyama ..... F01P 7/04

FOREIGN PATENT DOCUMENTS

JP 2006125274 A * 5/2006
JP 2006-161745 A 6/2006
JP 2009-068363 A 4/2009
JP 2011-122559 A 6/2011
JP 2011-179460 A 9/2011
JP 2012197706 A * 10/2012
JP WO 2014192747 A1 * 12/2014 ..... F01P 7/167
JP 2015-172355 A 10/2015
JP 2015-178787 A 10/2015
JP 2015-178824 A 10/2015
JP 2015178824 A * 10/2015 ..... F01P 3/02

OTHER PUBLICATIONS

German Office Action dated Oct. 23, 2018 as issued in corresponding German Application No. 11 2016 003 821.6 and its partial English translation thereof.
Japanese Office Action dated Dec. 18, 2018 as issued in corresponding Japanese Application No. 2016-001233 and its partial English translation thereof.
Toyama: Non-Final Office Action on U.S. Appl. No. 15/761,178 dated Nov. 28, 2018.
German Office Action dated Jan. 22, 2019 in corresponding German Application No. 112017000301.6 with partial English translation thereof.

* cited by examiner

COOLING DEVICE FOR INTERNAL COMBUSTION ENGINE OF VEHICLE AND CONTROL METHOD THEREOF

TECHNICAL FIELD

The present invention relates to a cooling device for an internal combustion engine of a vehicle and to a control method thereof, and specifically relates to a technique for controlling the cooling device when the internal combustion engine is automatically stopped while the vehicle is stopping.

BACKGROUND ART

Patent Document 1 discloses a cooling device including an electric water pump for circulating cooling water. In the second period after the engine is stopped, the cooling device maintains the electric water pump in an operating state and controls the control valve such that only the cooling water circulation through the cylinder head is permitted. Thereby, the cooling device prevents preignition at the start-up of the engine.

REFERENCE DOCUMENT LIST

Patent Document

Patent Document 1: JP 2009-068363 A

SUMMARY OF THE INVENTION

Problem to be Solved by the Invention

There is a vehicle that includes an idle reduction function to automatically stop the internal combustion engine while the vehicle is stopping. In such a vehicle, if the deterioration of the vehicle air heating performance during idle reduction can be suppressed, the comfort of the vehicle will be improved. Furthermore, if the temperature of the cylinder head during idle reduction can be controlled to be low, the retarded degree of ignition timing required for avoiding knocking at the vehicle start will be reduced, and fuel economy during acceleration at the vehicle start will be improved.

In view of the above, an object of the present invention is to provide a cooling device for an internal combustion engine of a vehicle and a control method thereof, which are capable of suppressing the deterioration of the vehicle air heating performance when the internal combustion engine is automatically stopped while the vehicle is stopping and capable of improving fuel economy during acceleration at the vehicle start from such an automatic stop state.

Means for Solving the Problem

To this end, the cooling device for an internal combustion engine of a vehicle according to the present invention comprises: an electric water pump for circulating cooling water; a first path including a cooling water passage in a cylinder head and extending through a heater core for vehicle air heating and a radiator; a second path bypassing the heater core and the radiator; path switching means for controlling an opening area of the second path; and control means which, when the internal combustion engine is automatically stopped while the vehicle is stopping, causes the electric water pump to operate and causes the path switching means to reduce the opening area of the second path as compared to before the internal combustion engine is automatically stopped.

A method for controlling cooling device for an internal combustion engine of a vehicle according to the present invention is a control method for a cooling device including: an electric water pump for circulating cooling water; a first path including a cooling water passage in a cylinder head and extending through a heater core for vehicle air heating and a radiator; and a second path bypassing the heater core and the radiator. The method comprises the steps of: detecting whether or not the internal combustion engine is automatically stopped while the vehicle is stopping; controlling so as to cause the electric water pump to operate when the internal combustion engine is automatically stopped; and increasing a ratio of a cooling water circulation rate through the first path while reducing a ratio of a cooling water circulation rate through the second path when the internal combustion engine is automatically stopped.

Effects of the Invention

According to the invention as described above, when the internal combustion engine is automatically stopped while the vehicle is stopping, an increased ratio of the cooling water circulates through the path for supplying the heater core and radiator with the cooling water that has been heated by cooling the cylinder head of the internal combustion engine so that the cooling water can release heat at the heater core and radiator. This allows for suppressing the deterioration of the vehicle air heating performance when the internal combustion engine is automatically stopped while the vehicle is stopping. In addition, the present invention allows accelerating the temperature decrease of the cylinder head with a limited discharge rate of the electric water pump. This reduces the retarded degree of ignition timing required for avoiding knocking at the vehicle start, and improves fuel economy during acceleration at the vehicle start from such an automatic stop state.

MODES FOR CARRYING OUT THE INVENTION

Figure 1:
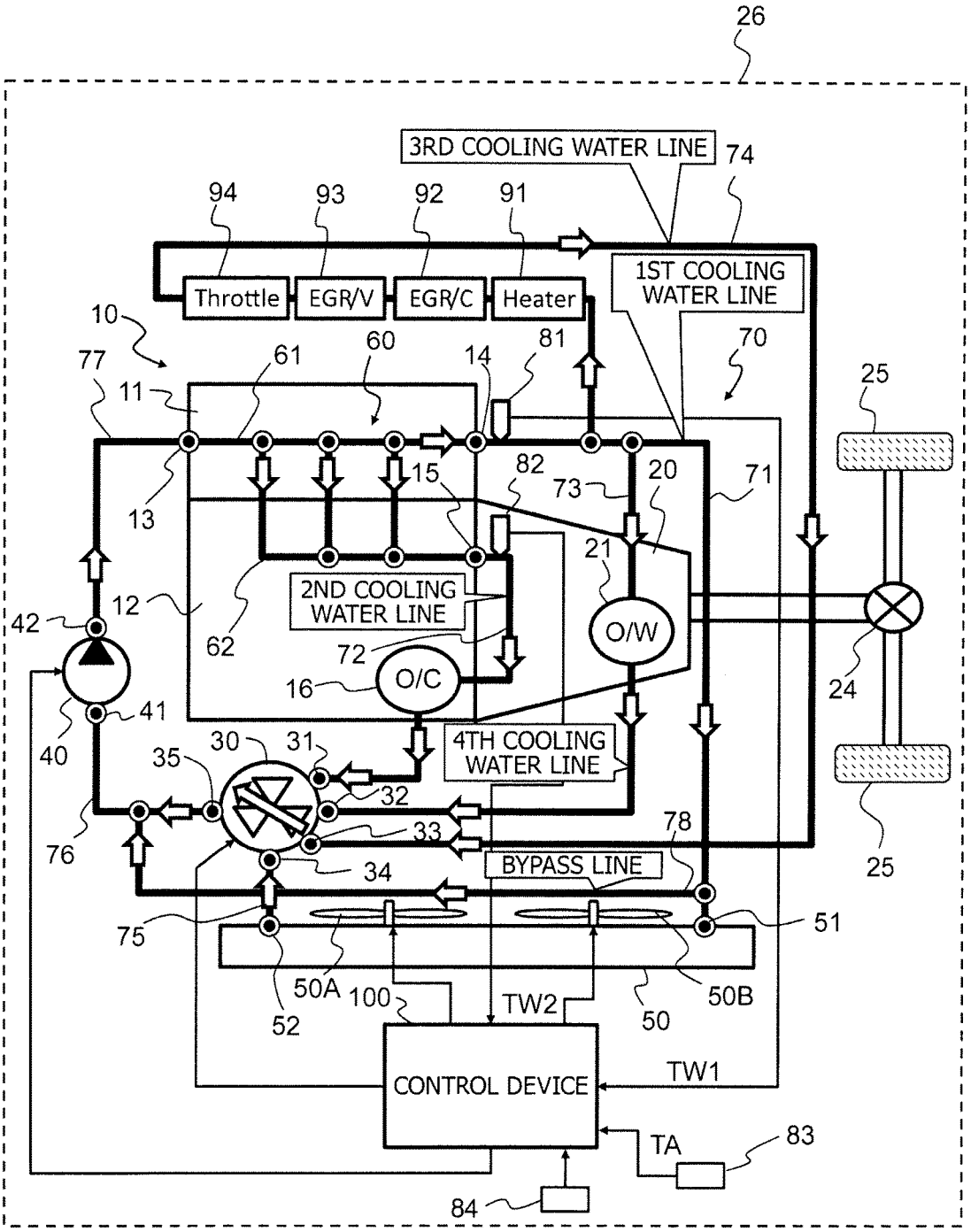
FIG. 1 is a schematic system view of the cooling device for an internal combustion engine according to an embodiment of the present invention.

An embodiment of the present invention will be described below. FIG. 1 is a configuration diagram illustrating an example of a cooling device for an internal combustion engine of a vehicle according to the present invention. As used herein, the term "cooling water" encompasses various coolants used in cooling devices for an internal combustion engine of a vehicle, such as antifreeze coolants standardized under Japanese Industrial Standard K 2234 (Engine antifreeze coolants).

An internal combustion engine 10 is installed in a vehicle 26 and used as a power source for driving vehicle 26. A transmission 20 such as a continuously variable transmission (CVT), an example of a powertrain, is coupled to the output shaft of internal combustion engine 10. The output of transmission 20 is transmitted to drive wheels 25 of vehicle 26 via a differential gear 24.

Internal combustion engine 10 is cooled by a water-based cooling device which circulates cooling water through a circulation passage. The cooling device includes a flow rate control valve 30, which serves as a path switching means, an electric water pump 40, a radiator 50, a cooling water passage 60 provided in internal combustion engine 10, an oil cooler 16 for internal combustion engine 10, a heater core 91, an oil warmer 21 for transmission 20, pipes 70 connecting these components, and the like. Oil cooler 16 is a heat exchanger for internal combustion engine oil. Oil warmer 21 is a heat exchanger for transmission oil.

Internal combustion engine 10 has a cylinder head cooling water passage 61 and a cylinder block cooling water passage 62, which collectively serve as cooling water passage 60 in internal combustion engine 10. Cylinder head cooling water passage 61, which has a function of cooling a cylinder head 11, extends in cylinder head 11 so as to connect a cooling water inlet 13 to a cooling water outlet 14 which are provided to cylinder head 11. In cylinder head 11, cooling water inlet 13 is provided at one end in the cylinder arrangement direction, and cooling water outlet 14 is provided at the other end in the cylinder arrangement direction.

Cylinder block cooling water passage 62, which has a function of cooling a cylinder block 12, branches off from cylinder head cooling water passage 61 and enters cylinder block 12. Cylinder block cooling water passage 62 extends in cylinder block 12 and is connected to a cooling water outlet 15 provided to cylinder block 12. Cooling water outlet 15 of cylinder block cooling water passage 62 is provided at an end, on the same side where cooling water outlet 14 of cylinder head cooling water passage 61 is provided, in the cylinder arrangement direction.

In this cooling device illustrated in FIG. 1, the cooling water is supplied through cylinder head 11 to cylinder block 12. The cooling water supplied to cylinder head 11 circulates through at least either path of: a circulation path through which the cooling water bypasses cylinder block cooling water passage 62 and is discharged from cooling water outlet 14; and a circulation path through which the cooling water enters cylinder block cooling water passage 62 and is then discharged from cooling water outlet 15. To cooling water outlet 14 of cylinder head 11, one end of a first cooling water pipe 71 is connected. The other end of first cooling water pipe 71 is connected to a cooling water inlet 51 of radiator 50.

To cooling water outlet 15 of cylinder block cooling water passage 62, one end of a second cooling water pipe 72 is connected. The other end of second cooling water pipe 72 is connected to a first inlet port 31 among four inlet ports 31 to 34 of flow rate control valve 30. In the middle of second cooling water pipe 72, oil cooler 16 for cooling lubricating oil for internal combustion engine 10 is disposed. Oil cooler 16 is a heat exchanger for reducing the temperature of lubricating oil by exchanging heat between the cooling water flowing through second cooling water pipe 72 and the lubricating oil for internal combustion engine 10.

One end of a third cooling water pipe 73 is connected to first cooling water pipe 71. The other end of third cooling water pipe 73 is connected to second inlet port 32 of flow rate control valve 30. In the middle of third cooling water pipe 73, oil warmer 21 is disposed which is a heat exchanger for heating hydraulic oil in transmission 20, which is a hydraulic mechanism. Oil warmer 21 exchanges heat between the cooling water flowing through third cooling water pipe 73 and the hydraulic oil in transmission 20. In other words, third cooling water pipe 73 allows the cooling water having increased in temperature while flowing through cylinder head 11 to be partially diverted and introduced into oil warmer 21. Oil warmer (oil warmer and cooler) 21 accelerates the temperature rise in the hydraulic oil in transmission 20 during cold engine start, and then maintains the hydraulic oil temperature in transmission 20 properly by avoiding an excessive rise in the oil temperature.

One end of a fourth cooling water pipe 74 is connected a to first cooling water pipe 71 at a point between cooling water outlet 14 and the junction with third cooling water pipe 73. The other end of fourth cooling water pipe 74 is connected to third inlet port 33 of flow rate control valve 30. Various heat exchanging devices are disposed on fourth cooling water pipe 74. The heat exchanging devices disposed on fourth cooling water pipe 74 are, in the order from upstream to downstream, heater core 91 for vehicle air heating, a water-based EGR (exhaust gas recirculation) cooler 92, an EGR control valve 93, and a throttle valve 94. EGR cooler 92 and EGR control valve 93 constitute an EGR device of internal combustion engine 10. Throttle valve 94 regulates the rate of air intake into internal combustion engine 10.

Heater core 91, which is a heat exchanger for heating air for air-conditioning included in a vehicle air heater, exchanges heat between the cooling water flowing through fourth cooling water pipe 74 and the air for air-conditioning so as to heat the air for air-conditioning. EGR cooler 92, which is a heat exchanger for cooling recirculated exhaust, exchanges heat between the cooling water flowing through fourth cooling water pipe 74 and the exhaust recirculated into an intake system of internal combustion engine 10 by the EGR device so as to lower the temperature of the exhaust recirculated into the intake system of internal combustion engine 10.

EGR control valve 93 for regulating the exhaust recirculation rate and throttle valve 94 for regulating the rate of air intake into internal combustion engine 10 are heated by exchanging heat with the cooling water flowing through fourth cooling water pipe 74. Heating EGR control valve 93 and throttle valve 94 with the cooling water prevents the freezing of moisture in the exhaust around EGR control valve 93 as well as moisture in the intake air around throttle valve 94.

As described above, fourth cooling water pipe 74 allows the cooling water having passed through cylinder head cooling water passage 61 to be partially diverted and introduced into heater core 91, EGR cooler 92, EGR control valve 93, and throttle valve 94 so as to exchange heat therewith. One end of a fifth cooling water pipe 75 is connected to a cooling water outlet 52 of radiator 50. The other end of fifth cooling water pipe 75 is connected to fourth inlet port 34 of flow rate control valve 30.

Flow rate control valve 30 has a single outlet port 35. One end of a sixth cooling water pipe 76 is connected to outlet port 35. The other end of sixth cooling water pipe 76 is connected to an intake port 41 of electric water pump 40. One end of a seventh cooling water pipe 77 is connected to a discharge port 42 of electric water pump 40. The other end of seventh cooling water pipe 77 is connected to cooling water inlet 13 of cylinder head 11.

One end of an eighth cooling water pipe 78 (radiator-bypass pipe) is connected to first cooling water pipe 71. The other end of eighth cooling water pipe 78 is connected to sixth cooling water pipe 76. Specifically, in first cooling water pipe 71, the point where eighth cooling water pipe 78 is connected is located downstream to the point connected to third cooling water pipe 73 and downstream to the point connected to fourth cooling water pipe 74. As described above, flow rate control valve 30 has four inlet ports 31 to 34 and one outlet port 35. Cooling water pipes 72, 73, 74, 75 are respectively connected to inlet ports 31, 32, 33, 34, and sixth cooling water pipe 76 is connected to outlet port 35.

Flow rate control valve 30 is a rotational flow channel switching valve that includes a stator having ports formed therein, and a rotor having flow channels formed therein and being fitted in the stator. When flow rate control valve 30 is actuated by the electric actuator such as an electric motor, the electric actuator rotationally drives the rotor, thereby changing the angle of the rotor relative to the stator. In rotational flow rate control valve 30 as described above, the opening area ratio of four inlet ports 31 to 34 changes depending on the rotor angle. The ports in the stator and the flow channels in the rotor are adapted such that a desirable opening area ratio, in other words, a desirable flow rate ratio among the cooling water lines may be achieved through selection of the rotor angle.

In the cooling device with the above configuration, cylinder head cooling water passage 61, first cooling water pipe 71, radiator 50, and fifth cooling water pipe 75 constitute a first cooling water line (radiator line) through which the cooling water circulates through cylinder head cooling water passage 61 and radiator 50, and bypasses cylinder block cooling water passage 62. Cylinder block cooling water passage 62, second cooling water pipe 72, and oil cooler 16 constitute a second cooling water line (block line) through which the cooling water circulates through cylinder block cooling water passage 62 and oil cooler 16, and bypasses radiator 50.

Cylinder head cooling water passage 61, fourth cooling water pipe 74, heater core 91, EGR cooler 92, EGR control valve 93, and throttle valve 94 constitute a third cooling water line (heater line) through which the cooling water circulates through cylinder head cooling water passage 61 and heater core 91, and bypasses radiator 50. Cylinder head cooling water passage 61, third cooling water pipe 73, and oil warmer 21 constitute a fourth cooling water line (powertrain line) through which the cooling water circulates through cylinder head cooling water passage 61 and oil warmer 21, and bypasses radiator 50.

In addition, eighth cooling water pipe 78 allows the cooling water flowing from cylinder head 11 to radiator 50 through the first cooling water line to be partially diverted to flow through eighth cooling water pipe 78. The diverted flow of cooling water bypasses radiator 50, and enters back the first cooling water line at a point downstream to the outlet of flow rate control valve 30. In other words, even when inlet ports 31 to 34 of flow rate control valve 30 are closed, eighth cooling water pipe 78 allows the cooling water having passed through cylinder head cooling water passage 61 to circulate bypassing radiator 50. In this way, eighth cooling water pipe 78 constitutes a bypass line. The cooling water circulation passage according to this embodiment includes the first to fourth cooling water lines and the bypass line.

As described above, the inlet ports of flow rate control valve 30 are connected respectively to the outlets of the first to fourth cooling water lines, and the outlet port of flow rate control valve 30 is connected to the intake port of electric water pump 40. Flow rate control valve 30 is a flow channel switching mechanism (path switching means) for controlling the supply rates of the cooling water respectively to the first to fourth cooling water lines, in other words, the cooling water allocation ratio between the first to fourth cooling water lines, by regulating the opening areas of the respective outlets of the first to fourth cooling water lines.

Radiator 50 includes electric radiator fans 50A, 50B. Electric water pump 40, flow rate control valve 30, and electric radiator fans 50A, 50B described above are controlled by a control device (control means) 100. Control device 100 includes a microcomputer including a CPU (processor), a ROM, a RAM, and the like.

Control device 100 receives measurement signals from various sensors for sensing operational conditions of internal combustion engine 10. The above various sensors include a first temperature sensor 81, a second temperature sensor 82, and an external air temperature sensor 83. First temperature sensor 81 measures a temperature of the cooling water in first cooling water pipe 71 near cooling water outlet 14, i.e., a cooling water temperature TW1 near the outlet of cylinder head 11. Second temperature sensor 82 measures a temperature of the cooling water in second cooling water pipe 72 near cooling water outlet 15, i.e., a cooling water temperature TW2 near the outlet of cylinder block 12. External air temperature sensor 83 measures an external air temperature TA. In the cooling device, second temperature sensor 82 may be omitted, and the cooling device may include only first temperature sensor 81 as a sensor for measuring cooling water temperature.

In addition, control device 100 receives a signal from an engine switch (ignition switch) 84 for turning internal combustion engine 10 on and off. In response, control device 100 controls the rotor angle of flow rate control valve 30 and the rotation speed (i.e., discharge flow rate) of electric water pump 40 in accordance with operational conditions of internal combustion engine 10.

Below, an implementation of cooling control performed by control device 100 during the operation of internal combustion engine 10 will be described. Flow rate control valve 30 is configured to allocate cooling water among the cooling water lines based on the allocation ratio selected from those associated with multiple modes. Control device 100 controls the rotor angle of flow rate control valve 30 and the rotation speed of electric water pump 40 in accordance with one of these modes that is selected according to operational conditions of internal combustion engine 10.

Figure 2:
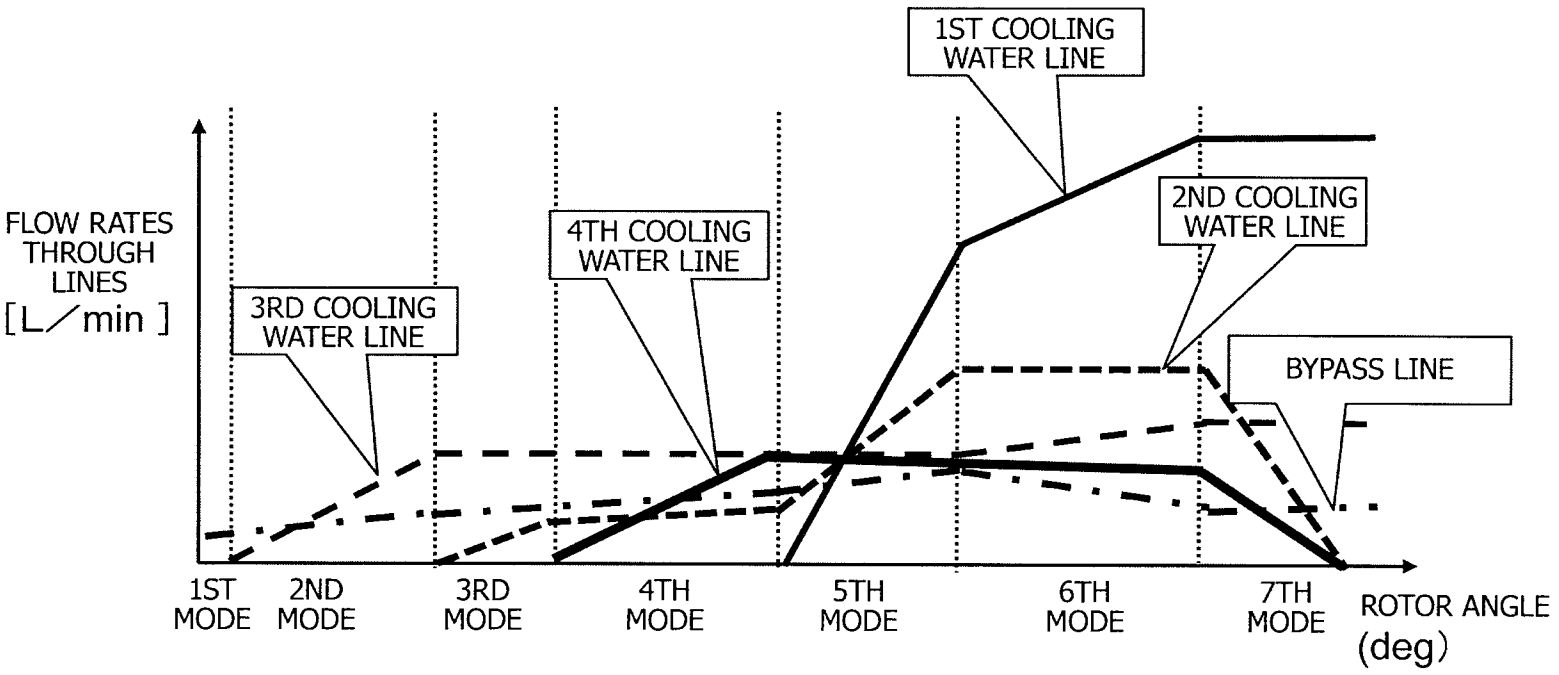
FIG. 2 is a graph illustrating the correlation between the rotor angle and the modes of the flow rate control valve according to the embodiment of the present invention.

FIG. 2 exemplifies the correlation between the rotor angle of flow rate control valve 30 and the expected flow rates of the cooling water lines in each mode, where the cooling water flow rates are also affected by the rotation speed control of electric water pump 40. At cold engine start, control device 100 controls flow rate control valve 30 such that its rotor angle falls within a predetermined angular range from a reference angular position at which the rotor is positionally regulated by a stopper. Thereby, flow rate control valve 30 enters a first mode in which all inlet ports 31 to 34 are closed.

In this first mode, at which all inlet ports 31 to 34 are closed, electric water pump 40 circulates the cooling water only through the bypass line. In other words, at cold engine start, control device 100 controls flow rate control valve 30 according to the first mode, so that cooling water circulates through cylinder head cooling water passage 61, bypassing the heat exchangers including radiator 50.

Additionally, in this first mode, control device 100 causes electric water pump 40 to operate at a sufficiently low rotation speed so as to minimize the circulation rate of cooling water. This allows for detection of the temperature rise in cylinder head 11 based on the rise in the cooling water temperature at the outlet of cylinder head 11 as well as quick warm-up of cylinder head 11. Note that the state in which flow rate control valve 30 closes all inlet ports 31 to 34 in the first mode includes not only the condition in which the opening area of each of inlet ports 31 to 34 is zero, but also the conditions in which the opening area of each of inlet ports 31 to 34 is reduced to the minimum value which permits a small leak of the cooling water. Note also that the rotor angle used herein indicates a rotation angle from the reference angular position at which the rotor is positionally regulated by the stopper.

When the rotor angle of flow rate control valve 30 is increased to greater than the angular range for the first mode, flow rate control valve 30 is switched to a second mode. In the second mode, third inlet port 33 connected to the outlet of the third cooling water line is opened while the other inlet ports 31, 32, 34 are maintained closed. Control device 100 switches from the first mode to the second mode after the temperature of cylinder head 11 reaches a predetermined temperature. Thereby, control device 100 increases the flow rate of cooling water circulating through heater core 91 so as to allow the air heating function to work more effectively at the startup, and heat and prevent freezing of EGR control valve 93 and throttle valve 94.

In accordance with a rise in the block outlet water temperature, control device 100 further increases the rotor angle beyond the angular range of the second mode so as to switch flow rate control valve 30 to a third mode. In the third mode, in addition to third inlet port 33 connected to the outlet of the third cooling water line, first inlet port 31 connected to the outlet of the second cooling water line is also opened so as to cool cylinder block 12 as well as the oil in internal combustion engine 10. When the block outlet water temperature reaches a target temperature, control device 100 further increases the rotor angle beyond the angular range of the third mode so as to switch flow rate control valve 30 to a fourth mode. In the fourth mode, in addition to third inlet port 33 connected to the outlet of the third cooling water line and first inlet port 31 connected to the outlet of the second cooling water line, second inlet port 32 connected to the outlet of the fourth cooling water line is also opened so as to warm the oil in transmission 20 and reduce friction in transmission 20. When second temperature sensor 82 is omitted from the cooling device, control device 100 controls switching to the third mode and further to the fourth mode in accordance, for example, with the measurement of the engine oil temperature.

When the warming-up of internal combustion engine 10 is completed through the above process, control device 100 opens the first cooling water line in addition to the second to fourth cooling water lines in accordance with the water temperature rise so as to maintain the water temperature at the cylinder head outlet and the water temperature at the cylinder block outlet at their respective target temperatures. In other words, control device 100 switches flow rate control valve 30 to a fifth mode in which all the first to fourth cooling water lines are opened. Thereby, control device 100 adjusts the flow rate of cooling water circulating through radiator 50. Further, when the water temperature rises above the target temperature for the fifth mode, control device 100 further increases the rotor angle beyond the angular range of the fifth mode so as to switch flow rate control valve 30 to a sixth mode. The sixth mode allows maximizing the ratio of cooling water circulation through the first cooling water line.

In addition to controlling the rotor angle of flow rate control valve 30 in accordance with the rise in the water temperature, control device 100 also controls the discharge flow rate of electric water pump 40 in accordance with the change in the water temperature, specifically, the difference between the target water temperature and the actual water temperature. During engine warm-up, control device 100 accelerates the warm-up by limiting the discharge flow rate to a low level. After the completion of the engine warm-up, control device 100 increases the discharge flow rate when the water temperature exceeds the target temperature so as to maintain the water temperature around the target temperature. The first to sixth modes are control modes of flow rate control valve 30 during the operation of internal combustion engine 10. During the period in which internal combustion engine 10 is automatically stopped by the idle reduction function, control device 100 keeps electric water pump 40 operating and controls flow rate control valve 30 according to the seventh mode. The seventh mode is also referred herein to as an idle reduction mode or an automatic stop mode.

The idle reduction function of internal combustion engine 10 is a function of: automatically stopping internal combustion engine 10 when a predetermined idle reduction condition is satisfied while vehicle 26 is stopping in order, for example, to wait for a traffic light to change; and restarting internal combustion engine 10 automatically in response to a "vehicle start" request or the like. Control device 100 may have an idle reduction control function for stopping idling of internal combustion engine 10. Alternatively, a different control device may have such an idle reduction control function. In such a case, control device 100 starts to control flow rate control valve 30 according to the seventh mode upon receiving a signal indicating that internal combustion engine 10 is in idle reduction from this different control device.

As shown in FIG. 2, the seventh mode is associated with an angular range beyond the angular range of the sixth mode. As the rotor angle increases within the angular range of the seventh mode, the second and fourth cooling water lines are narrowed in opening area, and finally closed off. Thus, as the rotor angle increases in the seventh mode, the ratio of the cooling water circulation rate through the first and third cooling water lines increases relative to that through the second and fourth cooling water lines. In other words, the first and third cooling water lines constitute a first path extending through heater core 91 and radiator 50, and the second and fourth cooling water lines constitute a second path bypassing heater core 91 and radiator 50. Note that the closed-off state of a cooling water line includes the conditions with a small leak, i.e., conditions in which cooling water flows through the cooling water line at a flow rate below a predetermined value.

The sixth mode is an all-path flow mode in which the cooling water circulates through all the paths, including the first to fourth cooling water lines. The seventh mode is an automatic stop mode in which, as compared to the all-path flow mode, an increased ratio of cooling water circulates through the first path (first and third cooling water lines) extending through heater core 91 and radiator 50, whereas a reduced ratio of cooling water circulates through the second path (second and fourth cooling water lines) bypassing heater core 91 and radiator 50.

The seventh mode described above is used for suppressing the deterioration of the air heating performance of vehicle 26 during idle reduction, and for accelerating the temperature decrease of cylinder head 11 during idle reduction in order to reduce the retarded degree of ignition timing required for avoiding knocking during acceleration at the vehicle start from the idle reduction state and improve the fuel economy during such acceleration. The processing performed by control device 100 according to the seventh mode during idle reduction will be described in detail below.

Figure 3:
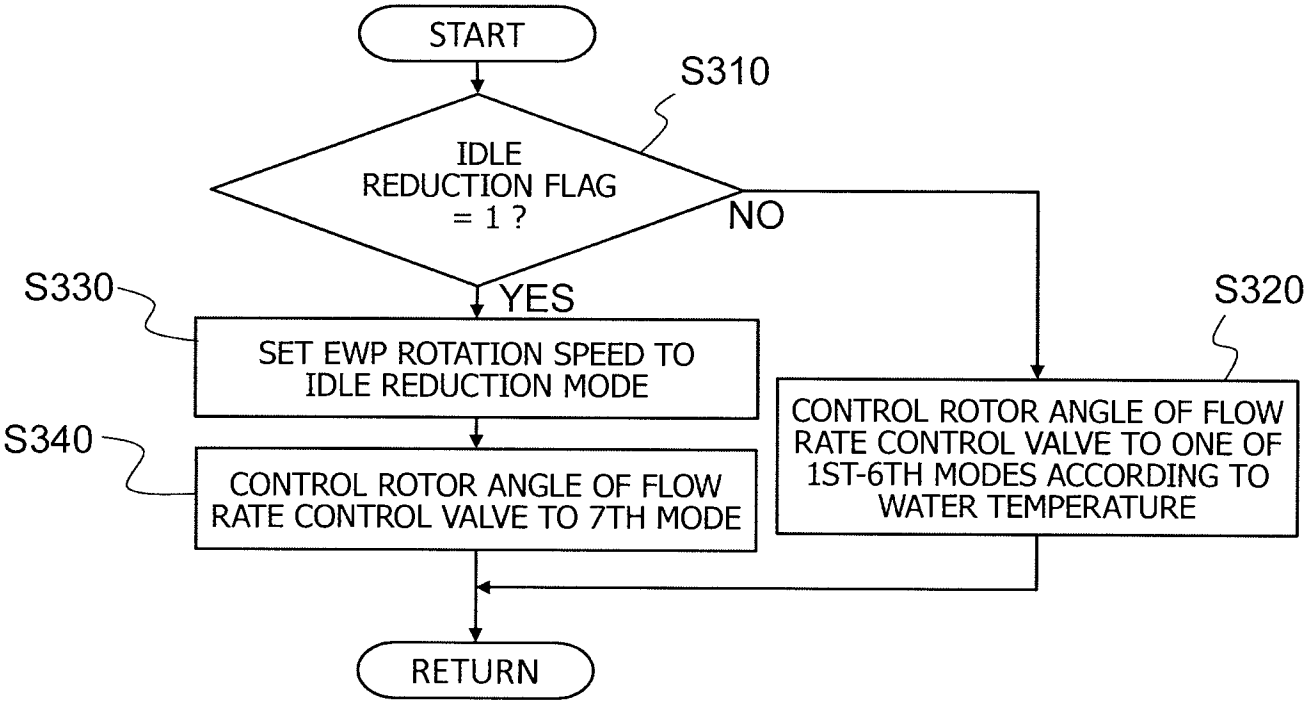
FIG. 3 is a flowchart illustrating the flow of controlling the flow rate control valve and the electric water pump according to the embodiment of the present invention.

The flowchart of FIG. 3 illustrates a main routine of the control of electric water pump 40 and flow control valve 30 performed by control device 100. The main routine illustrated in the flowchart of FIG. 3 is interruptedly executed by control device 100 at predetermined time intervals. In step S310, first, control device 100 checks an idle reduction flag, which is turned on when internal combustion engine 10 is in an idle reduction state.

When the idle reduction flag is off, that is, when internal combustion engine 10 is not in an idle reduction state but in an operating state, the operation proceeds to step S320. In step S320, control device 100 performs cooling control by switching between the first to sixth modes as described above. On the other hand, when the idle reduction flag is on, that is, when internal combustion engine 10 is automatically stopped by the idle reduction function, the operation proceeds to step S330.

Figure 4:
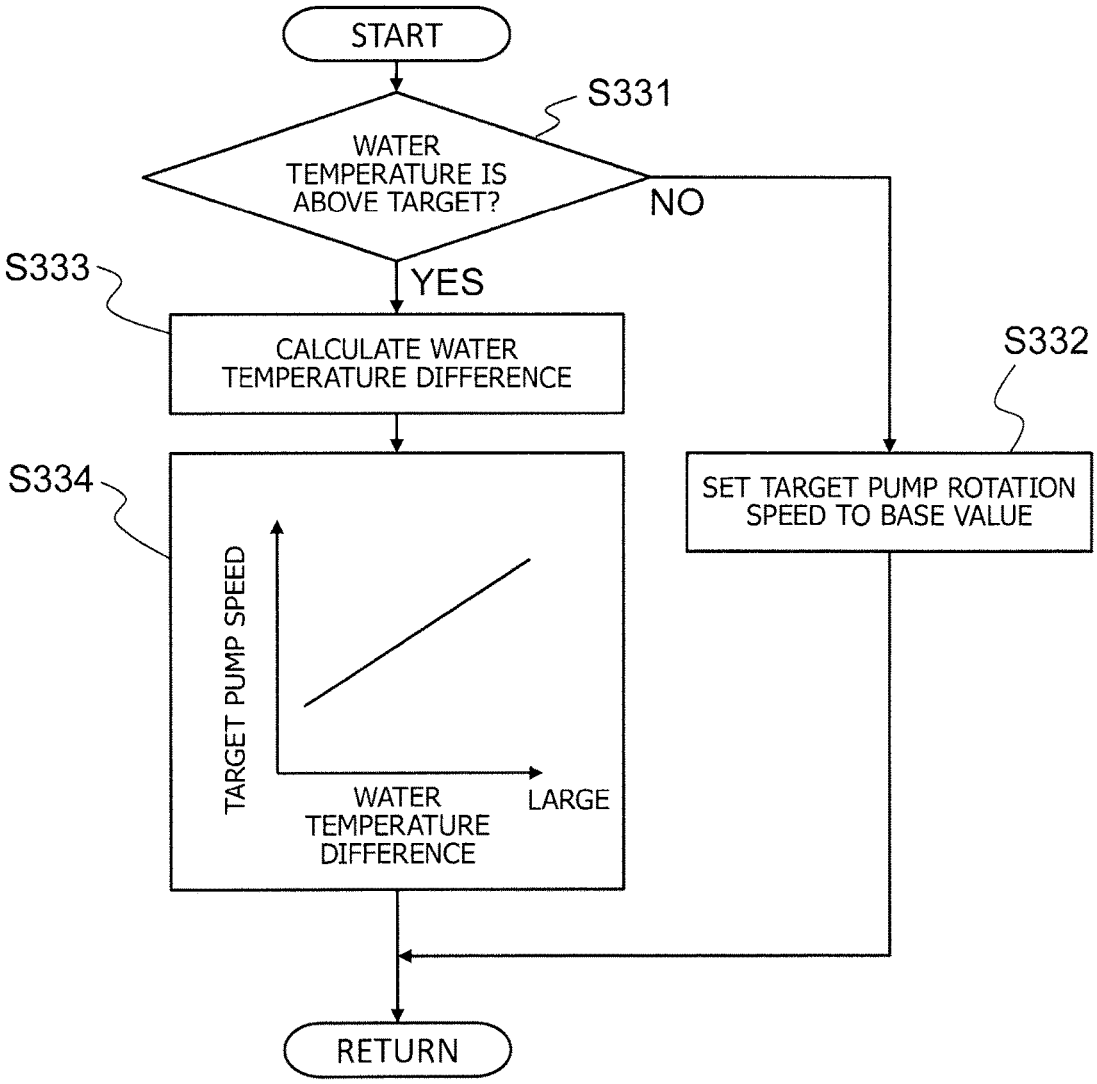
FIG. 4 is a flowchart illustrating a control for setting the target rotation speed of the electric water pump according to the embodiment of the present invention.

In step S330, control device 100 sets the target rotation speed of electric water pump 40 to the target value for the idle reduction state. An example of processing for setting the target rotation speed in step S330 will be described with reference to the flowchart of FIG. 4.

In step S331, control device 100 determines whether or not the head outlet water temperature is above the target temperature for the idle reduction state, where the target temperature for the idle reduction state<the target temperature for the operating state of internal combustion engine 10. When the head outlet water temperature is equal to or below the target temperature for the idle reduction state, the operation proceeds to step S332. In step S332, control device 100 sets the target pump rotation speed for the idle reduction state to a base rotation speed, for example, to the minimum target engine speed (>0 rpm). When the head outlet water temperature is above the target temperature, the operation proceeds to step S333. In step S333, control device 100 calculates the water temperature difference TWDC between the current head outlet water temperature and the target temperature for the idle reduction state (TWDC=head outlet water temperature−target temperature).

Then, the operation proceeds to step S334, in which control device 100 sets the target pump rotation speed such that the greater the water temperature difference TWDC, in other words, the higher the head outlet water temperature above the target temperature for the idle reduction state, the higher the target pump rotation speed. In other words, control device 100 sets the target pump rotation speed to the base rotation speed when the head outlet water temperature is equal to or below the target temperature for the idle reduction state. Then, as the head outlet water temperature increases above the target temperature for the idle reduction state, control device 100 increases the target pump rotation speed above the base rotation speed.

This increases the circulation rate of the cooling water during idle reduction as the head outlet water temperature increases above the target temperature. Thus, the cylinder head temperature can be rapidly reduced to a temperature that sufficiently assures reduction or prevention of knocking during acceleration at the vehicle start from the idle reduction state. In step S334, control device 100 sets the target pump rotation speed such that the higher the head outlet water temperature above the target temperature, the higher the target pump rotation speed. Alternatively, in place of or in combination with the water temperature difference TWDC, a parameter different from the water temperature difference TWDC may be used in variably setting the target pump rotation speed.

As long as affecting the cooling performance of reducing the temperature of cylinder head 11, various parameters may be used in variably setting the target pump rotation speed for the idle reduction state. For example, control device 100 varies the target pump rotation speed (pump discharge flow rate) for the idle reduction state depending on the external air temperature, the difference between the external air temperature and the head outlet water temperature, the rotor angle of flow rate control valve 30, operational conditions of internal combustion engine 10 before idle reduction, the operational status of electric radiator fans 50A, 50B, and/or the like.

The higher the external air temperature, the less easily is the temperature of cylinder head 11 reduced. Accordingly, control device 100 may be programmed to vary the target pump rotation speed for the idle reduction state such that the higher the external air temperature, the higher the target pump rotation speed. Similarly, the less the difference between the external air temperature and the head outlet water temperature, the less easily is the cylinder head temperature reduced. Accordingly, control device 100 may be programmed to vary the target pump rotation speed for the idle reduction state such that the greater the difference between the external air temperature and the head outlet water temperature, the higher the target pump rotation speed.

Furthermore, the temperature of cylinder head 11 can be reduced less easily during a transitional state within the seventh mode, i.e., while the rotor angle has entered the angular range of the seventh mode, but has not yet reached the angle at which the second and fourth cooling water lines become closed. This is because, in such a transitional state, cooling water is still supplied to the second and fourth cooling water lines, each of which bypasses radiator 50. Accordingly, control device 100 may be programmed to vary the target pump rotation speed such that the greater the difference between the actual rotor angle of flow rate control valve 30 and the rotor angle at which the second and fourth cooling water lines become closed, i.e., the greater the opening areas (cooling water supply ratios) of the second and fourth cooling water lines, the higher the target pump rotation speed.

Also, when the operational conditions of internal combustion engine 10 before idle reduction involve a large amount of heat generation, the cylinder head temperature can be less easily reduced during idle reduction. Accordingly, control device 100 may be programmed to increase the target pump rotation speed when, for example, internal combustion engine 10 operates at higher load and rotation speed for a long time before idle reduction. Furthermore, the less the air volume blown by electric radiator fans 50A, 50B, the less easily reduced the temperature of cylinder head 11. Accordingly, control device 100 may be programmed to vary the target pump rotation speed such that the lower the electric current and voltage for driving electric radiator fans 50A, 50B during idle reduction, the higher the target pump rotation speed.

In step S330 of the flowchart of FIG. 3, control device 100 sets a target rotation speed (target discharge flow rate or target cooling water circulation rate) of electric water pump 40 during idle reduction in a manner as described above, and controls the drive motor for electric water pump 40 based on the target speed (>0 rpm). Furthermore, the operation proceeds to step S340, in which control device 100 controls the target rotor angle of flow rate control valve 30 within the angular range of the seventh mode, which is adapted to the idle reduction state. Here, during idle reduction, control device 100 may maintain the target rotor angle of flow rate control valve 30 within the seventh mode. However, control device 100 does not have to maintain the target rotor angle within the seventh mode. Control device 100 may switch between the modes in accordance with the need for oil cooling or the like.

Figure 5:
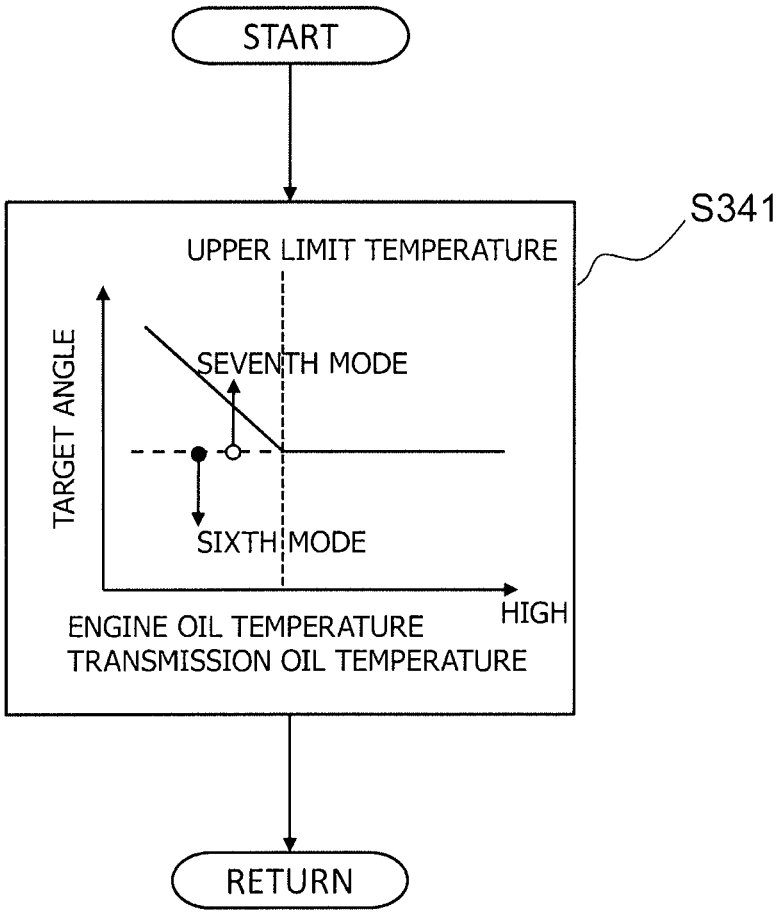
FIG. 5 is a flowchart illustrating a control of the flow rate control valve performed in accordance with the oil temperatures during idle reduction according to the embodiment of the present invention.

The flowchart of FIG. 5 illustrates, as an example of processing for setting the rotor angle in the step S340, processing for switching the modes in accordance with the need for oil cooling. In step S341, control device 100 sets the target rotor angle of flow rate control valve 30 for the idle reduction state depending on the temperatures of the oil (lubricating oil) in internal combustion engine 10 and/or the oil (hydraulic oil) in transmission 20. The control apparatus 100 can perform this oil temperature-based mode switching depending on either one of the oil temperature of internal combustion engine 10 and the oil temperature of transmission 20 that is selected as a representative oil temperature.

For example, control device 100 may select, as the representative oil temperature, whichever higher of the oil temperatures of internal combustion engine 10 and transmission 20. Alternatively, control device 100 may calculate the difference between the actual and standard values of the oil temperature of internal combustion engine 10 as well as the difference between the actual and standard values of the oil temperature of transmission 20, and select, as the representative oil temperature, whichever having a greater difference from its standard value of the two. Still alternatively, control device 100 may calculate the degree of engine oil cooling need based on the oil temperature of internal combustion engine 10 as well as the degree of transmission oil cooling need based on the oil temperature of transmission 20, and switches between the modes depending on whichever oil cooling has the higher degree of need. Still alternatively, control device 100 may switch between the modes depending, for example, on the average of the oil temperatures of internal combustion engine 10 and transmission 20.

In the seventh mode, which is adapted for idle reduction, control device 100 closes the second and fourth cooling water lines to stop the cooling water circulation through oil cooler 16 and oil warmer 21. However, even in the seventh mode, when the temperatures of the lubricating oil in internal combustion engine 10 and/or the hydraulic oil in transmission 20 are above their upper limit temperatures and need to be reduced, it is necessary to circulate cooling water through oil cooler 16 and oil warmer 21 by giving priority to component protection than fuel efficiency at the vehicle start from the idle reduction state.

Thus, when there is a need for oil cooling, such as when the oil temperatures are above their upper limit temperatures, control device 100 uses the target rotor angle of the all-path flow mode, i.e., the fifth or sixth mode, so as to open all the first to fourth cooling water lines. In response, the cooling water starts to circulate through oil cooler 16 on the second cooling water line as well as oil warmer 21 on the fourth cooling water line. This reduces the oil temperatures of internal combustion engine 10 and transmission 20 below their upper limit temperatures, and allows achieving component protection.

On the other hand, when the oil temperatures are equal to or below their upper limit temperatures, control device 100 uses the target rotor angle of the seventh mode. Thereby, control device 100 reduces the supply rates of the cooling water to the second and fourth cooling water lines as the oil temperatures decrease, so that the supply rates of the cooling water to the first and third cooling water lines are relatively increased. During idle reduction, control device 100 accelerates the temperature decrease of cylinder head 11 by increasing the supply rate of the cooling water to the first cooling water line, i.e., the supply rate of the cooling water circulating through cylinder head 11 and then radiator 50. This lowers the probability of knocking in internal combustion engine 10 at the restart from the idle reduction state, and allows control device 100 to advance ignition timing of internal combustion engine 10. Thus, the fuel economy of internal combustion engine 10 during acceleration at the vehicle start is improved.

It might be considered that, during idle reduction, control device 100 can increase the supply rate of the cooling water circulating through cylinder head 11 and then radiator 50 by increasing the discharge rate of electric water pump 40 while supplying the cooling water to the first to fourth cooling water lines. However, this causes electric water pump 40 to consume more electric power during idle reduction. Accordingly, the above method can accelerate the temperature decrease of cylinder head 11, but only at the expense of less improvement in fuel economy brought by idle reduction.

In contrast, stopping cooling water flow through the second and fourth cooling water lines allows a relative increase in the cooling water circulation rate through the first and third cooling water lines even without changing the discharge rate of electric water pump 40. Thus, electric power consumption by electric water pump 40 less diminishes the improvement in fuel economy brought by the temperature decrease of cylinder head 11. Furthermore, during idle reduction, control device 100 increases the supply rate of the cooling water to the third cooling water line in addition to the first cooling water line. In other words, control device 100 increases the rate of the cooling water circulating through heater core 91 during idle reduction. This curbs the temperature decrease of air for air conditioning at the air outlet during idle reduction while the vehicle air heater is on. Thus, it is possible to curb the decrease in vehicle interior temperature and improve air heating performance during idle reduction.

After the temperature of cylinder head 11 has been reduced to the target temperature during idle reduction, heat is no longer generated in internal combustion engine 10. Accordingly, in this case, there is an option to stop the cooling water circulation through cylinder head 11. However, stopping such cooling water circulation causes variation in temperature within the cooling water circulation passage, and causes first temperature sensor 81 to no longer accurately measure the temperature of cylinder head 11. In light of the above, as illustrated in the flow chart of FIG. 6, when the temperature of cylinder head 11 has been reduced to the target temperature during idle reduction, control device 100 may set the target rotation speed of electric water pump 40 to a rotation speed (>0 rpm) low enough to provide only the minimum circulation rate that sufficiently reduces such temperature variation.

Figure 6:
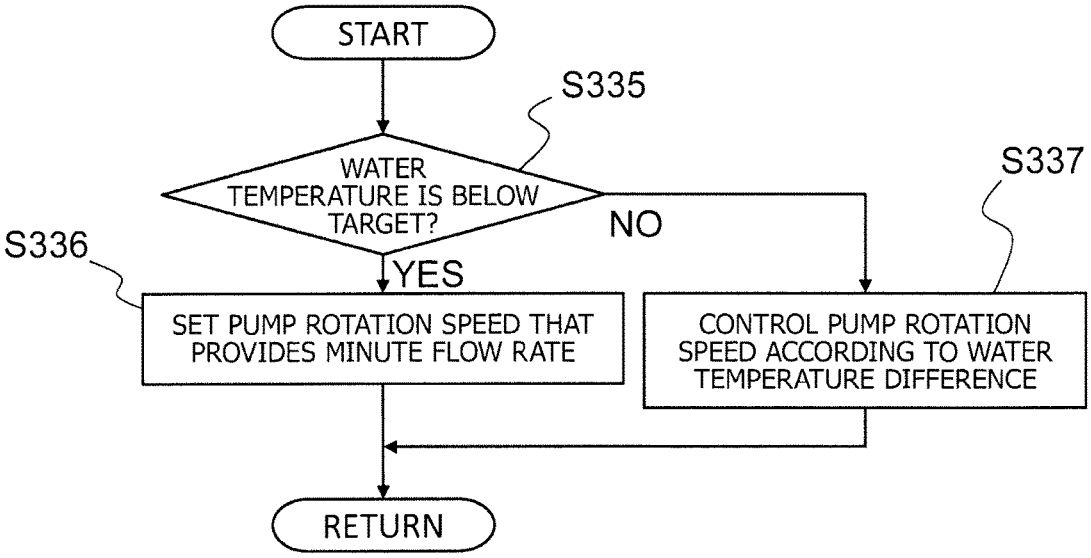
FIG. 6 is a flowchart illustrating a control for setting the target rotation speed of the electric water pump after the water temperature has been reduced during idle reduction according to the embodiment of the present invention.

The flowchart of FIG. 6 illustrates an example of the details of the processing in step S330 in the flowchart of FIG. 3. In step S335, control device 100 compares the head outlet water temperature with the target temperature. When the head outlet water temperature is below the target temperature, the operation proceeds to step S336. In step S336, control device 100 sets the target rotation speed of electric water pump 40 to a rotation speed low enough to provide only the minimum circulation rate that sufficiently reduces variation in temperature within the cooling water circulation passage. As a result, electric water pump 40 operates at a minimal rotation speed.

On the other hand, when the head outlet water temperature is equal to or above the target temperature, the operation proceeds to step S337. In step S337, control device 100 fixes the target rotation speed of electric water pump 40 to the target value for cooling acceleration in the seventh mode (idle reduction state), or varies the target rotation speed depending, for example, on the difference between the head outlet water temperature and the target temperature. Thereby, control device 100 accelerates the temperature decrease of cylinder head 11 and ensures the air heating performance. In other words, in step S337, control device 100 can set the target rotation speed in the same manner as in steps S333 to S334.

The target rotation speed set in step S337, which is higher than the target rotation speed set in step S336, is high enough to provide a circulation rate that ensures acceleration of the temperature decrease of cylinder head 11. As described above, when the head outlet water temperature falls below the target temperature, control device 100 controls the rotation speed of electric water pump 40 so as to provide only the minimum circulation rate that sufficiently reduces variation in temperature within the cooling water circulation system. In this way, during idle reduction, control device 100 reduces variation in temperature within the cooling water circulation system so as to maintain the measurement accuracy of the temperature of cylinder head 11 while limiting electric power consumption of electric water pump 40.

Furthermore, the above method more effectively suppresses the deterioration of the air heating performance than stopping the cooling water flow through heater core 91 during idle reduction. Here, after the temperature of cylinder head 11 (the head outlet water temperature) has been reduced to the target temperature during idle reduction, the additional cooling water allocation to the first cooling water line for accelerating the temperature decrease of cylinder head 11 is no longer necessary. Thus, at that time, control device 100 is allowed to increase the cooling water circulation rate through the second and fourth cooling water lines (resume the cooling water flow through the second and fourth cooling water lines).

Figure 7:
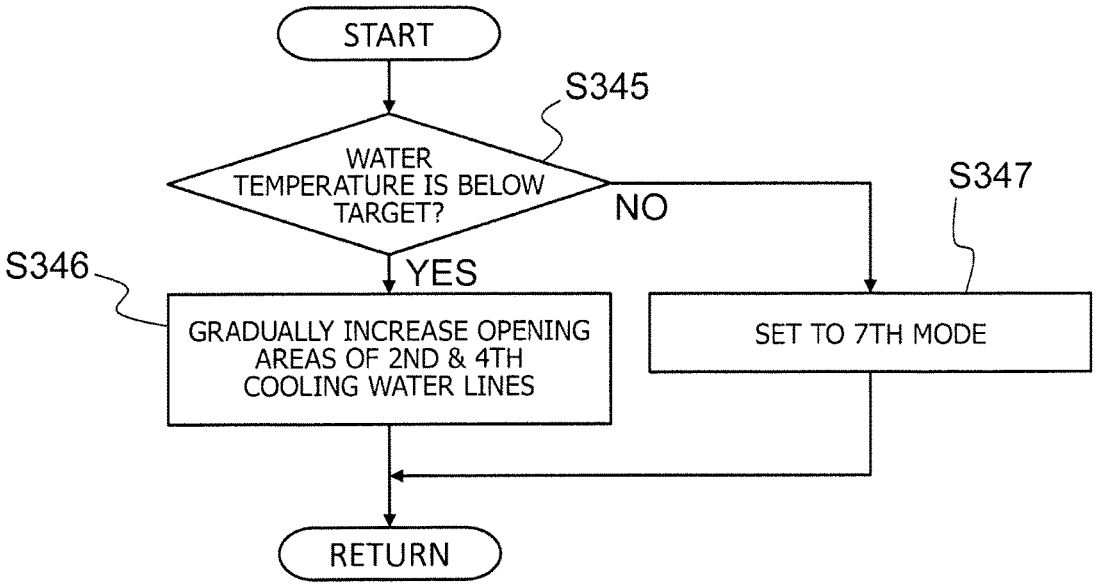
FIG. 7 is a flowchart illustrating a control for resuming cooling water flow through the second and fourth cooling water lines in response to a decrease in the water temperature during idle reduction according to the embodiment of the present invention.

The flowchart of FIG. 7 illustrates an example of the details of the processing in step S340 in the flowchart of FIG. 3. In step S345, control device 100 compares the head outlet water temperature with the target temperature. When the head outlet water temperature is below the target temperature, the operation proceeds to step S346. In step S346, control device 100 cancels the stop of the cooling water flow through the second and fourth cooling water lines, and controls the target rotor angle of flow rate control valve 30 so as to gradually increase the opening areas of the second and fourth cooling water lines.

As a result, the high-temperature cooling water having stayed in the second and fourth cooling water lines gradually flows out, and the cooling water temperatures in the second and fourth cooling water lines gradually decrease. Thus, the above control prevents the high-temperature cooling water having stayed in the second and fourth cooling water lines from flowing out all at once and boosting the temperature of the entire cooling system upon engine restart. On the other hand, when the head outlet water temperature is equal to or above the target temperature, the operation proceeds to step S347. In step S347, control device 100 may set the target rotor angle to an angle according to the seventh mode, which stops cooling water flow through the second and fourth cooling water lines. Alternatively, as in step S341 described above, control device 100 may perform processing for determining, based on the oil temperatures, whether to permit or prohibit cooling water flow through the second and fourth cooling water lines.

In the example illustrated in the flowchart of FIG. 7, control device 100 resumes cooling water flow through the second and fourth cooling water lines when the head outlet water temperature decreases to a predetermined temperature during idle reduction. Alternatively, as illustrated in the flowchart of FIG. 8, control device 100 may resume cooling water flow through the second and fourth cooling water lines either when conditions for resuming the cooling water flow through the second and fourth cooling water lines are not satisfied during idle reduction or when the resumption of the cooling water flow through the second and fourth cooling water lines during idle reduction is prohibited.

Figure 8:
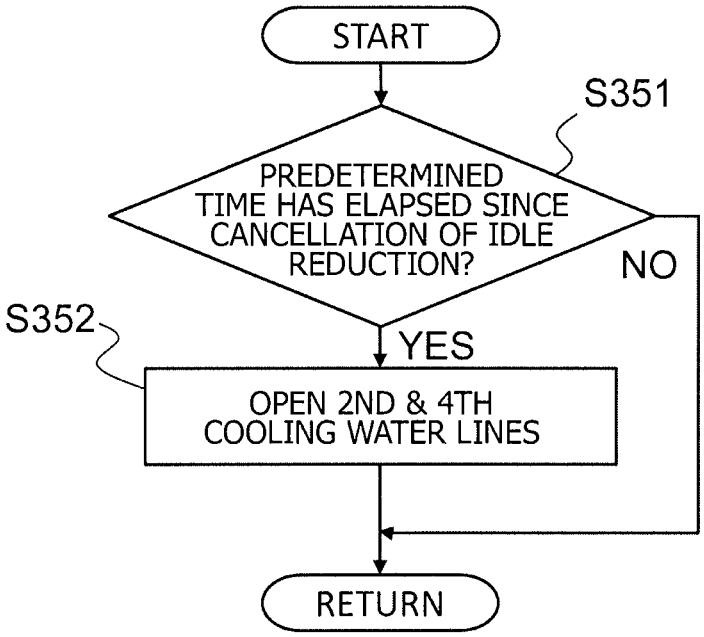
FIG. 8 is a flowchart illustrating a control for resuming cooling water flow through the second and fourth cooling water lines in response to the cancellation of idle reduction according to the embodiment of the present invention.

In the flowchart of FIG. 8, in step S351, control device 100 determines whether or not the amount of time elapsed since the operation of internal combustion engine 10 resumes in response to the cancellation of idle reduction has reached a predetermined time. When control device 100 determines that the predetermined time has elapsed since the resumption of engine operation, the operation proceeds to step S352. In step S352, control device 100 cancels the processing for stopping cooling water flow through the second and fourth cooling water lines (i.e., cancels the seventh mode) and switches, for example, to the fifth or sixth mode that allows the cooling water circulation through all the first to fourth cooling water lines.

Figure 9:
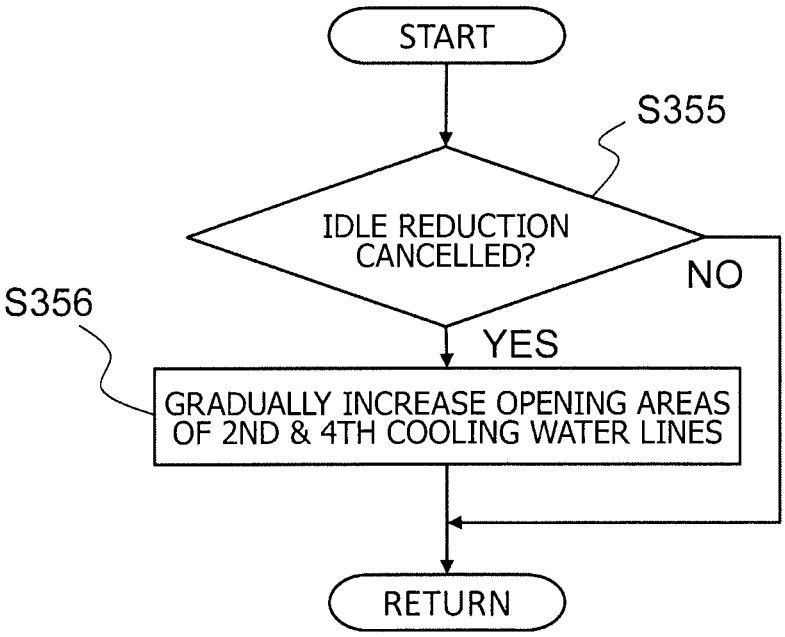
FIG. 9 is a flowchart illustrating another control for resuming cooling water flow through the second and fourth cooling water lines in response to the cancellation of idle reduction according to the embodiment of the present invention.

Thereby, the opening areas of the second and fourth cooling water lines are increased in a stepwise manner, thus permitting the outflow of the high-temperature cooling water having stayed in the second and fourth cooling water lines while the cooling water flow therethrough has been stopped. Here, this mode switching is performed after a sufficient amount of time has elapsed since the resumption of the operation of internal combustion engine 10, and thus its impact to the operation of internal combustion engine 10 is sufficiently curbed. As an alternative processing for resuming cooling water flow through the second and fourth cooling water lines after the resumption of the operation of internal combustion engine 10, control device 100 may perform processing illustrated in the flowchart of FIG. 9.

In step S355, control device 100 determines whether or not the operation of internal combustion engine 10 has resumed in response to the cancellation of idle reduction. When control device 100 determines that the operation of internal combustion engine 10 has resumed in response to the cancellation of idle reduction, the operation proceeds to step S356. In step S356, control device 100 cancels the stop of cooling water flow through the second and fourth cooling water lines, and controls the target rotor angle of flow rate control valve 30 so as to gradually increase the opening areas of the second and fourth cooling water lines.

Figure 10:
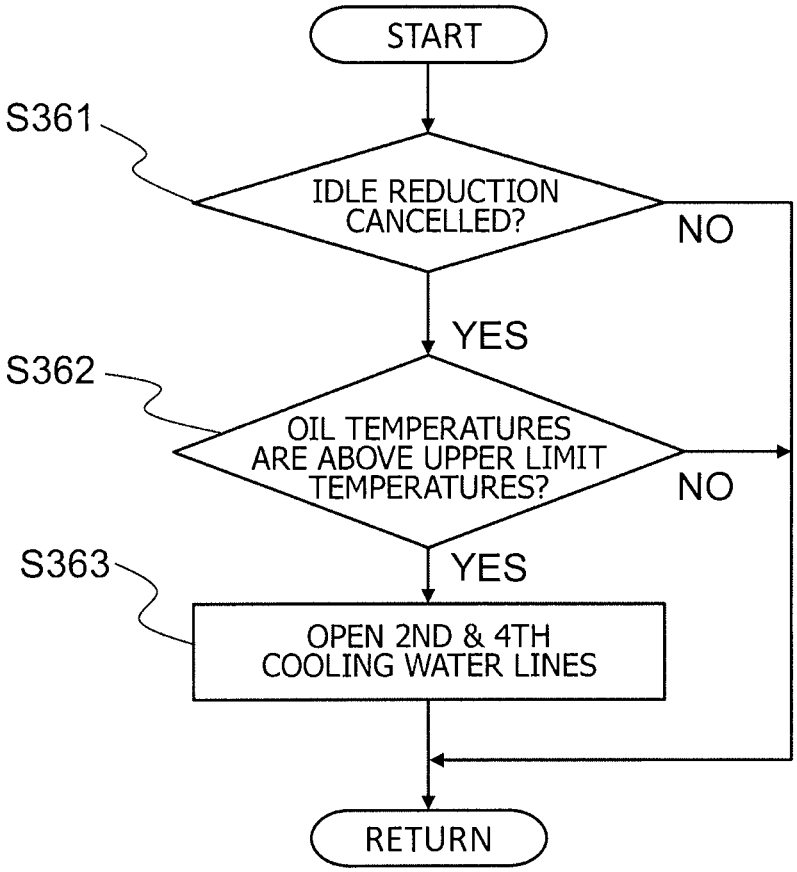
FIG. 10 is a flowchart illustrating a control for resuming cooling water flow through the second and fourth cooling water lines based on the oil temperatures after the cancellation of idle reduction according to the embodiment of the present invention.

As a result, the high-temperature cooling water that stayed in the second and fourth cooling water lines during idle reduction gradually flows out. Thus, the above control prevents the high-temperature cooling water that stayed in the second and fourth cooling water lines from flowing out all at once and boosting the temperature of the entire cooling system upon the cancellation of idle reduction. As an alternative processing for resuming cooling water flow through the second and fourth cooling water lines after the resumption of the operation of internal combustion engine 10, control device 100 may perform processing illustrated in the flowchart of FIG. 10.

In step S361, control device 100 determines whether or not the operation of internal combustion engine 10 has resumed in response to the cancellation of idle reduction. When control device 100 determines that the operation of internal combustion engine 10 has resumed in response to the cancellation of idle reduction, the operation proceeds to step S362. In step S362, control device 100 determines whether or not the oil temperatures are above their upper limit temperatures.

When control device 100 determines that the oil temperatures are below their upper limit temperatures, which indicates a low degree of need for circulating cooling water through oil cooler 16 and oil warmer 21, this routine ends immediately. Thereby, control device 100 continues to stop the cooling water flow through the second and fourth cooling water lines from during the previous idle reduction. On the other hand, when control device 100 determines that the oil temperatures are above their upper limit temperatures, the operation proceeds to step S363. In step S363, control device 100 resumes cooling water flow through the second and fourth cooling water lines by increasing the opening areas of the second and fourth cooling water lines in a stepwise manner. This allows a rapid reduction of the cooling water temperatures in the second and fourth cooling water lines, i.e., the oil temperatures of internal combustion engine 10 and/or transmission 20, thus allowing protection of the components of internal combustion engine 10 and transmission 20.

Figure 11:
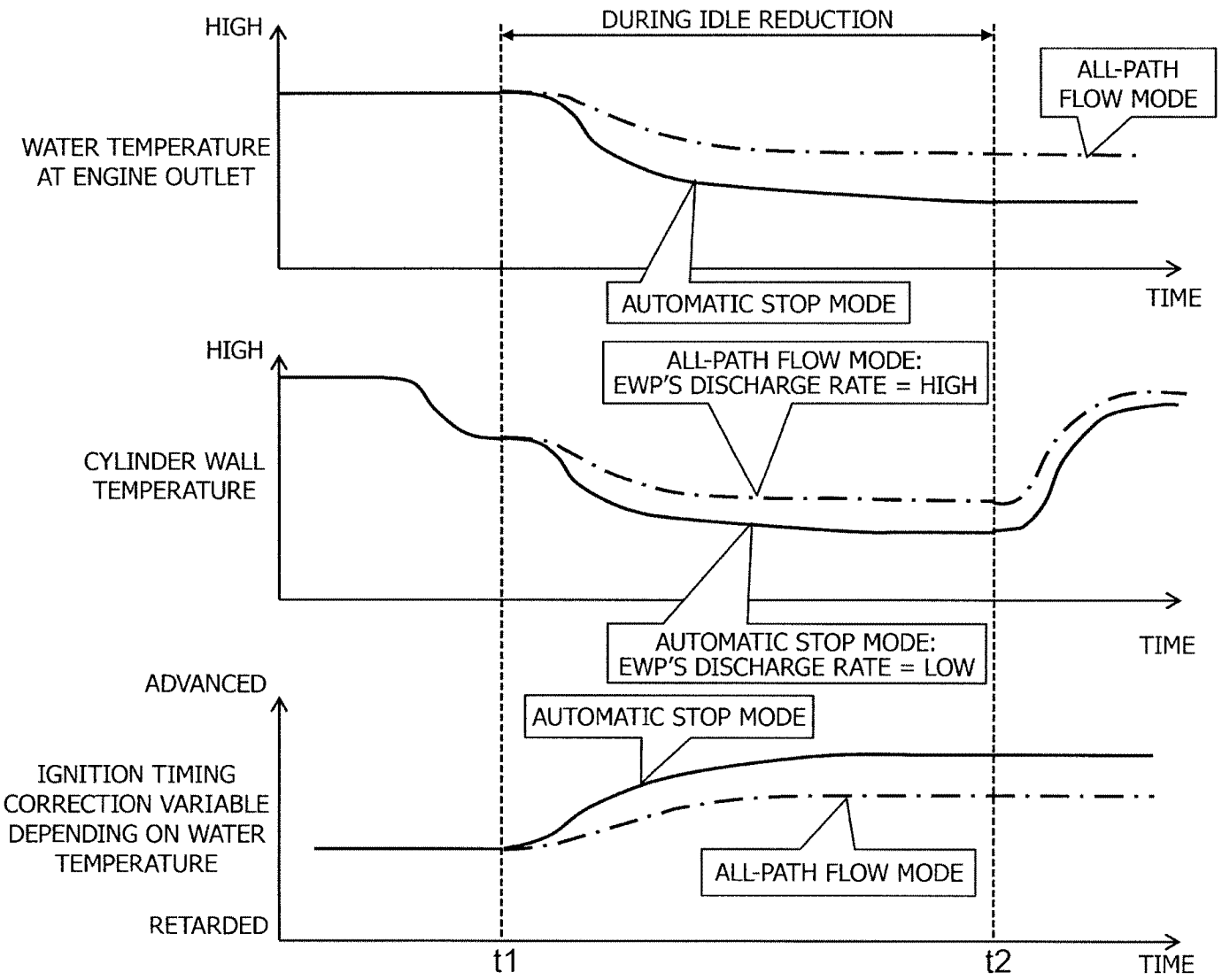
FIG. 11 is a time chart for illustrating water temperature lowering characteristics during idle reduction according to the embodiment of the present invention.

FIG. 11 is a time chart for illustrating the effect of the processing for stopping cooling water flow through the second and fourth cooling water lines during idle reduction. Specifically, FIG. 11 exemplifies changes in the following variables during idle reduction: the head outlet water temperature, the cylinder wall temperature, and an ignition timing correction variable which varies depending on temperature conditions. Assume here that cooling water flow through all the first to fourth cooling water lines is permitted and electric water pump 40 operates even during idle reduction (between time point t1 and time point t2). Even in such a case, it is possible to reduce the cylinder head temperature during idle reduction as illustrated in FIG. 11. However, when cooling water flow through the second and fourth cooling water lines is prohibited while cooling water flow through the first and third cooling water lines is permitted during idle reduction, the temperature decrease that matches or surpasses that achieved by permitting cooling water flow through all the first to fourth cooling water lines can be achieved even with a reduced rotation speed of electric water pump 40.

Furthermore, when the temperature of cylinder head 11, i.e., the combustion chamber wall temperature is reduced during idle reduction, the probability of knocking is reduced and the ignition timing can be further advanced. Such ignition timing advance leads to an increase in the output torque, thus improving fuel economy during acceleration at the vehicle start. Assume here that cooling water flow through the third cooling water line (heater core 91) is stopped in addition to the stop of cooling water flow through the second and fourth cooling water lines. This will reduce the temperature of cylinder head 11 more efficiently, but in turn will deteriorate air heating performance during idle reduction, thus permitting a decrease in vehicle interior temperature during air heating because the cooling water flow through heater core 91 is stopped.

Figure 12:
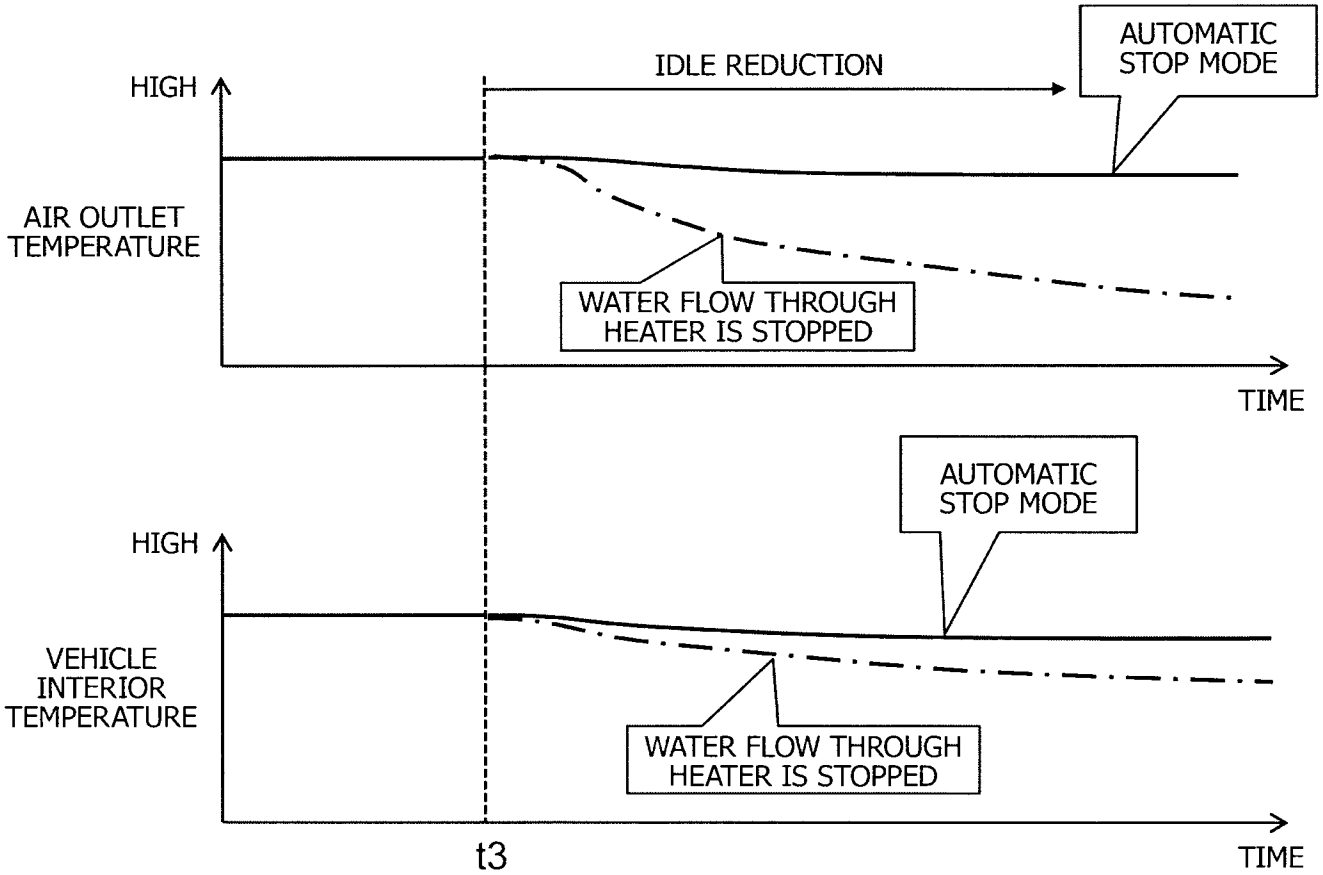
FIG. 12 is a time chart illustrating the characteristics of the air heating performance during idle reduction according to the embodiment of the present invention.

FIG. 12 is a time chart illustrating an example of the correlation between the presence or absence of cooling water flow through heater core 91 and each of the air outlet temperature and vehicle interior temperature. As illustrated in FIG. 12, if cooling water flow through the third cooling water line (heater core 91) is stopped during idle reduction (after time point t3), the temperature of air for air conditioning at the air outlet gradually decreases, so that the vehicle interior temperature decreases accordingly. In contrast, when electric water pump 40 operates and the cooling water flow through third cooling water line (heater core 91) continues during idle reduction, the air temperature at the air outlet is maintained unchanged. Thus, the decrease in vehicle interior temperature is suppressed during idle reduction.

Figure 13:
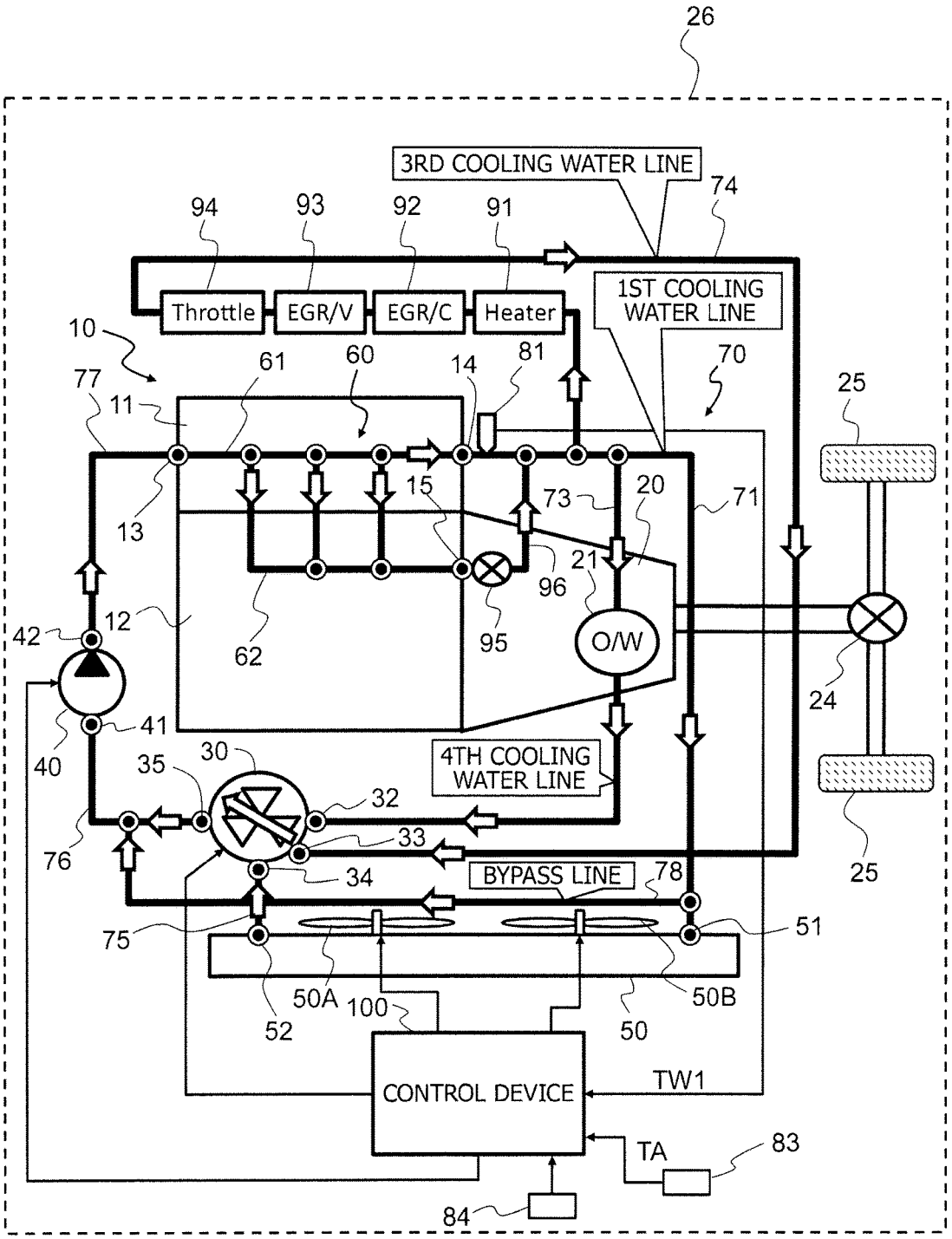
FIG. 13 is a schematic system view of the cooling device for an internal combustion engine according to an embodiment of the present invention.

The system configuration of FIG. 1 includes the first to fourth cooling water lines, and controls the cooling water flow rates through the cooling water lines by adjusting flow rate control valve 30. However, it is obvious that the present invention is not limited to such a configuration. For example, an implementation illustrated in FIG. 13 is also possible according to the present invention. The implementation has a system configuration in which flow rate control valve 30 controls the flow rates through the first, third and fourth cooling water lines, and a thermostat 95 controls the cooling water flow rate through cylinder block cooling water passage 62. Note that the same reference numerals are given to the same components in the system configuration illustrated in FIG. 13 as those in FIG. 1, and the detailed description of these components will be omitted.

In the system configuration of FIG. 13, thermostat 95 is disposed at the downstream end of cylinder block cooling water passage 62. Thermostat 95 opens or closes in response to the cooling water temperature. A ninth cooling water pipe 96 connects the outlet of thermostat 95 to first cooling water pipe 71, which is connected to the outlet of cylinder head cooling water passage 61. The junction of first cooling water pipe 71 and ninth cooling water pipe 96 is located upstream to the junction of fourth cooling water pipe 74 and first cooling water pipe 71.

Thus, thermostat 95 opens when the cooling water temperature in cylinder block cooling water passage 62 exceeds the valve opening temperature of thermostat 95. The open state of thermostat 95 allows the cooling water flowing through cylinder head cooling water passage 61 to be partially diverted into cylinder block cooling water passage 62. The cooling water having flowed through cylinder block cooling water passage 62 passes through thermostat 95, then flows through ninth cooling water pipe 96, and joins the cooling water flowing through first cooling water pipe 71.

The cooling water temperature to open thermostat 95 is set such that thermostat 95 is maintained closed in low and middle load operation states (within the normal operation range) of internal combustion engine 10 and that thermostat 95 opens in a high load operation state (approximately at 90 to 95° C., for example) of internal combustion engine 10. In the system of FIG. 13, the cooling water within cylinder block cooling water passage 62 is not confined therein while thermostat 95 is closed. Rather, cylinder block cooling water passage 62 is communicated with cylinder head cooling water passage 61 by a plurality of parallel passages so as to allow the cooling water within cylinder block cooling water passage 62 to be replaced as a result, for example, of the cooling water temperature difference between cylinder head cooling water passage 61 and cylinder block cooling water passage 62 even while thermostat 95 is closed.

In the system configuration of FIG. 13, the first cooling water line (radiator line), the third cooling water line (heater line), and the fourth cooling water line (powertrain line) are provided in the same manner as in the system configuration of FIG. 1. Flow rate control valve 30 has three inlet ports 32 to 34 connected to the first, third and fourth cooling water lines, and adjusts the cooling water flow rates through these cooling water lines depending on the rotor angle.

Figure 14:
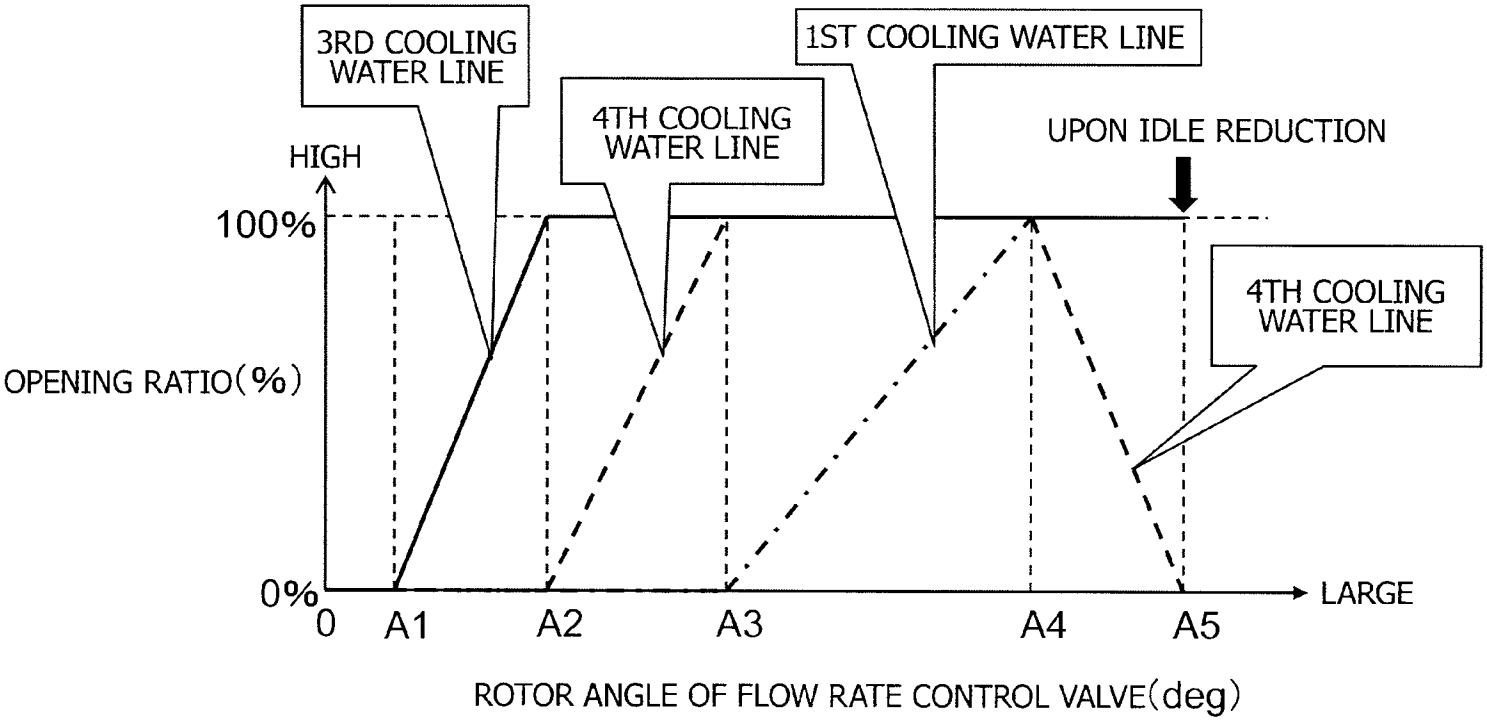
FIG. 14 is a graph for illustrating the correlation between the rotor angle and the opening ratio of the flow rate control valve of FIG. 13.

FIG. 14 illustrates an example of the correlation between the rotor angle of flow rate control valve 30 and the opening ratio (%) of each of inlet ports 32 to 34 in the system configuration of FIG. 13. The opening ratio herein refers to the ratio of the actual opening area to the full opening area of each of inlet ports 32 to 34. When the rotor angle of flow rate control valve 30 is equal to or below a first rotor angle A1 (between the angle corresponding to the stopper position and the first rotor angle A1), three inlet ports 32 to 34, which are connected to the first, third and fourth cooling water lines, are maintained fully closed (opening ratio=0%).

Then, as the rotor angle of flow rate control valve 30 exceeds and increases above the first rotor angle A1, the opening ratio of inlet port 33, connected to the third cooling water line, gradually increases with inlet ports 32, 34, connected to the first and fourth cooling water lines, maintained fully closed. The opening ratio of inlet port 33 reaches the maximum when the rotor angle becomes a second rotor angle A2. As the rotor angle further increases from the angular position A2, at which the opening ratio of inlet port 33 reaches the maximum, the opening ratio of inlet port 32, connected to the fourth cooling water line, gradually increases. The opening ratio of inlet port 33 reaches the maximum when the rotor angle becomes a third rotor angle A3. Thus, at the third rotor angle A3, inlet ports 32, 33 are both fully opened and inlet port 34 is maintained fully closed.

As the rotor angle further increases above the third rotor angle A3, the opening ratio of inlet port 34, connected to the first cooling water line, gradually increases. The opening ratio of inlet port 34 reaches the maximum when the rotor angle becomes a fourth rotor angle A4. Thus, at the fourth rotor angle A4, all inlet ports 32 to 34 are fully opened. As the rotor angle further increases above the fourth rotor angle A4, the opening ratio of inlet port 32, connected to the fourth cooling water line, gradually decreases from the maximum. Inlet port 32 becomes fully closed again when the rotor angle becomes a fifth rotor angle A5. Thus, at the fifth rotor angle A5, inlet port 32 (second path) is fully closed and inlet ports 33, 34 (first path) are maintained fully opened.

Here, the rotor angle of flow rate control valve 30 is controlled based on the reference position (initial position), which corresponds to 0 degrees, where 0 degrees<first rotor angle A1<second rotor angle A2<third rotor angle A3<fourth rotor angle A4<fifth rotor angle A5. In other words, the opening area of inlet port 33 (third cooling water line) increases in accordance with an increase in the rotor angle from the first rotor angle A1 to the second rotor angle A2, and inlet port 33 is maintained fully opened from the second rotor angle A2 to the fifth rotor angle A5.

Inlet port 32 (fourth cooling water line) is maintained fully closed from the first rotor angle A1 to the second rotor angle A2, and the opening area of inlet port 32 increases in accordance with an increase in the rotor angle from the second rotor angle A2 to the third rotor angle A3. Inlet port 32 is maintained fully opened from the third rotor angle A3 to the fourth rotor angle A4, and the opening area of inlet port 32 decreases in accordance with an increase in the rotor angle form the fourth rotor angle A4 to the fifth rotor angle A5. Inlet port 32 becomes fully closed again at the fifth rotor angle A5.

Inlet port 34 (first cooling water line) is maintained fully closed from the first rotor angle A1 to the third rotor angle A3, and the opening area of inlet port 34 increases in accordance with an increase in the rotor angle from the third rotor angle A3 to the fourth rotor angle A4. Inlet port 34 is maintained fully opened from the fourth rotor angle A4 to the fifth rotor angle A5. Note that, although FIG. 14 illustrates that the minimum opening ratio is 0% and the maximum opening ratio is 100%, the opening ratio of each inlet port of flow rate control valve 30 may be controlled within the range of 0%<opening ratio<100%, 0%≤opening ratio<100% or 0%<opening ratio≤100%.

Figure 15:
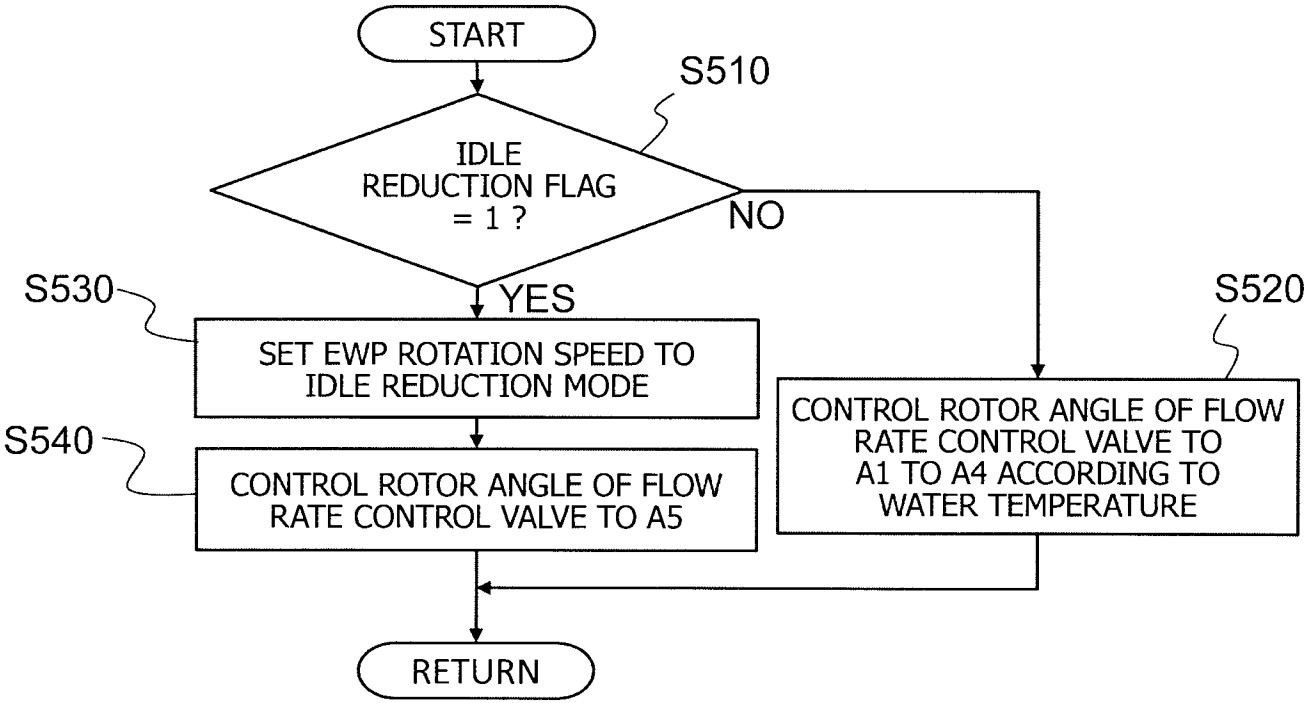
FIG. 15 is a flowchart illustrating the flow of controlling the flow rate control valve in the system configuration of FIG. 13.

Water temperature sensor 81 for measuring the head outlet water temperature is disposed at the outlet of cylinder head cooling water passage 61. In the cooling device having the above configuration, control device 100 controls the rotor angle of flow rate control valve 30, i.e., the cooling water flow rates through the first, third and fourth cooling water lines, in accordance with the flowchart of FIG. 15.

In step S510, first, control device 100 checks an idle reduction flag, which is turned on when internal combustion engine 10 is in an idle reduction state. When the idle reduction flag is off, that is, when internal combustion engine 10 is not in an idle reduction state but in an operating state, the operation proceeds to step S520. In step S520, control device 100 controls the rotor angle of flow rate control valve 30 within the angular range from the first rotor angle A1 to the fourth rotor angle A4 in accordance, for example, with the head outlet water temperature measured by water temperature sensor 81.

Specifically, in step S520, the rotor angle of flow rate control valve 30 is controlled in the same manner as in step S320 of the flowchart of FIG. 3. In other words, control device 100 increases the rotor angle of flow rate control valve 30 along with the progression of the warm-up of internal combustion engine 10, and sets the rotor angle to the fourth rotor angle A4 so as to fully open the first, third and fourth cooling water lines during a high load operation state in which the water temperature at the head outlet exceeds the target temperature.

In addition, control device 100 controls the rotation speed of electric water pump 40 in parallel to the control of the rotor angle of flow rate control valve 30 described above. In other words, during engine warm-up, control device 100 accelerates the warm-up by limiting the rotation speed of electric water pump 40 to a low level. After the completion of the engine warm-up, control device 100 increases the rotation speed of electric water pump 40 as compared to during engine warm-up. In particular, when internal combustion engine 10 operates at such a high load that the rotor angle is set to the fourth rotor angle A4, control device 100 further increases the rotation speed of electric water pump 40 so as to maintain the cooling performance at a sufficient level.

On the other hand, when the idle reduction flag is on, that is, when internal combustion engine 10 is automatically stopped by the idle reduction function, the operation proceeds to step S530. In step S530, control device 100 sets the target rotation speed of electric water pump 40 to the target value for the idle reduction state as in step S330.

Then, the operation proceeds to step S540 during the idle reduction state of internal combustion engine 10. In step S540, control device 100 sets the target rotor angle of flow rate control valve 30 to the fifth rotor angle A5 so as to fully open the first and third cooling water lines (first path) and fully close the fourth cooling water line (second path). Alternatively, in step S540, control device 100 may set the target rotor angle of flow rate control valve 30 to a different target rotor angle preset for the idle reduction state that satisfies: fourth rotor angle A4<target rotor angle preset for the idle reduction state<fifth rotor angle A5.

Here, in the cooling device, thermostat 95, which controls the cooling water flow rate through cylinder block cooling water passage 62, is kept closed during a normal idle reduction state. In other words, during idle reduction of internal combustion engine 10, cooling water flow through cylinder block cooling water passage 62 and oil warmer 21 (fourth cooling water line) is stopped (or reduced by narrowing the corresponding opening). As a result, most of the cooling water circulates through the first and third cooling water lines which are maintained fully opened during idle reduction.

Thus, even when thermostat 95 has been maintained fully closed so as to stop the cooling water circulation through cylinder block cooling water passage 62 and thermostat 95 since before the start of the idle reduction state, the cooling water having flowed through oil warmer 21 (fourth cooling water line) starts to additionally enter the first and third cooling water lines in response to reduction of the cooling water flow through oil warmer 21 (fourth cooling water line) upon the start of idle reduction.

Thus, during idle reduction, even though the discharge rate of electric water pump 40 is maintained unchanged from before the idle reduction, the cooling water flow rates through the first and third cooling water lines increase as compared to before idle reduction. An increase in the supply rate of the cooling water through the first cooling water line during idle reduction as compared to before idle reduction accelerates the temperature decrease of cylinder head 11 during idle reduction, thus lowering the probability of knocking in internal combustion engine 10 upon engine restart.

This allows control device 100 to further advance the ignition timing of internal combustion engine 10 during acceleration at the vehicle start from the idle reduction state. As a result, the fuel economy of internal combustion engine 10 during acceleration at the vehicle start is improved. Furthermore, during idle reduction, control device 100 increases the supply rate of the cooling water to the first cooling water line without increasing the discharge rate of electric water pump 40. This allows electric power consumption by electric water pump 40 to less diminish the improvement in fuel economy.

Furthermore, during idle reduction, control device 100 increases the supply rate of the cooling water to the third cooling water line in addition to the first cooling water line as compared to before idle reduction. In other words, control device 100 increases the rate of the cooling water circulating through heater core 91 during idle reduction. This curbs the temperature decrease of air for air conditioning (at the air outlet) during idle reduction while the vehicle air heater is on. Thus, it is possible to improve air heating performance during idle reduction.

During idle reduction, control device 100 may fix the target rotor angle of flow rate control valve 30 to the fifth rotor angle A5, but not exclusively. Alternatively, instead of fixing to the fifth rotor angle A5, control device 100 may variably control the rotor angle of flow rate control valve 30 within a range below the fifth rotor angle A5 in accordance, for example, with the need for oil cooling. Thereby, control device 100 controls the rate of the cooling water flow through oil warmer 21 (the fourth cooling water line) to a minimal value that satisfies the need for oil cooling instead of stopping the water flow therethrough. Specifically, control device 100 may variably control the rotor angle of flow rate control valve 30 during idle reduction within the range between the fourth rotor angle A4 and the fifth rotor angle A5 in accordance with the oil temperature of transmission 20.

For example, control device 100 may control the rotor angle of flow rate control valve 30 during idle reduction such that the higher the oil temperature of transmission 20, the smaller the rotor angle within the range between the fourth rotor angle A4 and the fifth rotor angle A5. Thereby, control device 100 may increase the cooling water flow rate through oil warmer 21 (fourth cooling water line) as the oil temperature increases. In this way, during idle reduction, control device 100 accelerates the temperature decrease of cylinder head 11 while avoiding an excessive rise in the oil temperature of transmission 20. Among the control measures employed in the system configuration of FIG. 1, those applicable to the system configuration of FIG. 13, i.e., those that are not related to the second cooling water line of FIG. 1, may also be employed in the system configuration of FIG. 13 as needed.

Although the invention has been described in detail with reference to the preferred embodiment, it is apparent that the invention may be modified in various forms by one skilled in the art based on the fundamental technical concept and teachings of the invention. In the above embodiments, cooling water flow through heater core 91 is maintained permitted during idle reduction. Alternatively, however, cooling water flow through heater core 91 may be permitted during idle reduction only when the air conditioner is in heating operation.

Furthermore, the configurations of the cooling water circulation paths and the flow rate control valve that allow processing for increasing the ratio of cooling water circulation through the heater core and radiator as compared to before automatic engine stop are not limited to those illustrated in FIG. 1 or 13. For example, a plurality of flow rate control valves may be used to switch between the cooling water circulation paths. In other words, any system configuration may produce effects similar to those produced by the above embodiments as long as the system configuration includes a cooling device having: a first path including a cooling water passage in the cylinder head and extending through a heater core for vehicle air heating and a radiator; and as long as a second path bypassing the heater core and the radiator, and the system configuration allows the opening area of the second path to be reduced in response to an automatic stop of the internal combustion engine while the vehicle is stopping.

A still alternative configuration may be employed which includes a cooling device in which the fourth cooling water line is omitted among the first to fourth cooling water lines illustrated in FIG. 1, and in which the second cooling water line is closed during idle reduction. When radiator 50 includes electric radiator fans 50A, 50B, control device 100 may control electric radiator fans 50A, 50B during idle reduction as follows. At a timing such as when cooling water flow through the second and fourth cooling water lines is stopped in the system of FIG. 1, or when cooling water flow through the fourth cooling water line is stopped in the system of FIG. 13, control device 100 apply a drive voltage to electric radiator fans 50A, 50B so that electric radiator fans 50A, 50B operate depending on the drive voltage. The drive voltage for electric radiator fans 50A, 50B may be either variable depending, for example, on the difference between the water temperature at the head outlet and its target temperature for the idle reduction state, or a fixed value adapted for the idle reduction mode. This allows for enhancement of the heat radiation performance of radiator 50, thus accelerating the temperature decrease of cylinder head 11 during idle reduction.

Furthermore, in the cooling water circulation path illustrated in FIG. 1, the cooling water having entered cylinder head 11 is partially diverted into cylinder block 12. Alternatively, however, the cooling water may be diverted at a point upstream to cylinder head 11 so as to be introduced individually to cylinder head 11 and cylinder block 12. The third cooling water line illustrated in FIGS. 1 and 13 extends through heater core 91, EGR cooler 92, EGR control valve 93, and throttle valve 94. However, the third cooling water line has only to extend through at least heater core 91, and is not limited to one extending through all of heater core 91, EGR cooler 92, EGR control valve 93, and throttle valve 94.

Furthermore, in the configuration illustrated in FIGS. 1 and 13, oil warmer 21 for transmission 20 is disposed on the fourth cooling water line as a heat exchanger for the powertrain. Alternatively, however, another oil cooler for the transmission being separate from oil warmer 21 may be additionally disposed on the fourth cooling water line. Furthermore, as an additional water pump for circulating the cooling water, a mechanical water pump driven by internal combustion engine 10 may be provided in addition to electric water pump 40. In such a configuration, the cooling water is circulated either by the mechanical water pump alone or by both the mechanical water pump and electric water pump 40 during the operating state of internal combustion engine 10, and the cooling water is circulated by electric water pump 40 during idle reduction. Furthermore, flow rate control valve 30 is not limited to a rotor type. For example, a flow rate control valve having a structure that includes a valve element configured to be linearly moved by an electric actuator may alternatively be used.

Below, technical concepts which can be grasped from the above embodiments will be described.

According to an aspect a cooling device for an internal combustion engine of a vehicle, the cooling device comprises: an electric water pump for circulating cooling water; a first path including a cooling water passage in a cylinder head and extending through a heater core for vehicle air heating and a radiator; a second path bypassing the heater core and the radiator; path switching means for controlling an opening area of the second path; and control means which, when the internal combustion engine is automatically stopped while the vehicle is stopping, causes the electric water pump to operate and causes the path switching means to reduce the opening area of the second path as compared to before the internal combustion engine is automatically stopped.

In a preferred aspect of the cooling device for the internal combustion engine of a vehicle, the control means reduces a rotation speed of the electric water pump in accordance with a decrease in a temperature of the cooling water after the internal combustion engine is automatically stopped.

In another preferred aspect, after the temperature of the cooling water has been reduced to a predetermined temperature after the internal combustion engine is automatically stopped, the control means maintains the electric water pump to operate at a predetermined lowest rotation speed.

In a still another preferred aspect, the second path extends through at least one of a heat exchanger for oil of the internal combustion engine and a heat exchanger for oil of a powertrain for the internal combustion engine, and, when the internal combustion engine is automatically stopped, the control means reduces the opening area of the second path such that the lower the temperature of the oil, the greater a reduction amount of the opening area of the second path.

In a still another preferred aspect, when the temperature of the cooling water has been reduced to a predetermined temperature after the internal combustion engine is automatically stopped, the control means increases the opening area of the second path.

In a still another preferred aspect, the control means increases the opening area of the second path after the temperature of the oil has reached a predetermined temperature after restart of the internal combustion engine.

In a still another preferred aspect, the control means increases the opening area of the second path after a predetermined delay time has elapsed since restart of the internal combustion engine.

In a still another preferred aspect, the first path includes: a radiator line including the cooling water passage in the cylinder head and extending through the radiator; and a heater line including the cooling water passage in the cylinder head, extending through the heater core and bypassing the radiator, the second path includes a powertrain line including the cooling water passage in the cylinder head, extending through the heat exchanger for the oil of the powertrain and bypassing the radiator, and when the internal combustion engine is automatically stopped while the vehicle is stopping, the control means causes the electric water pump to operate and causes the path switching means to reduce the opening area of the powertrain line.

In a still another preferred aspect, in addition to the powertrain line, the second path further includes a block line including a cooling water passage in a cylinder block, extending through the heat exchanger for the oil of the internal combustion engine and bypassing the radiator, and when the internal combustion engine is automatically stopped while the vehicle is stopping, the control means causes the electric water pump to operate and causes the path switching means to reduce the opening areas of the powertrain line and the block line.

According to an aspect of a method for controlling a cooling device for an internal combustion engine of a vehicle, the cooling device includes: an electric water pump for circulating cooling water; a first path including a cooling water passage in a cylinder head and extending through a heater core for vehicle air heating and a radiator; and a second path bypassing the heater core and the radiator, the method comprising the steps of: detecting whether or not the internal combustion engine is automatically stopped while the vehicle is stopping; controlling so as to cause the electric water pump to operate when the internal combustion engine is automatically stopped; and increasing a ratio of a cooling water circulation rate through the first path while reducing a ratio of a cooling water circulation rate through the second path when the internal combustion engine is automatically stopped.

REFERENCE SYMBOL LIST

10 internal combustion engine
11 cylinder head
12 cylinder block
16 oil cooler (heat exchanger)
20 transmission (powertrain)
21 oil warmer (heat exchanger)
30 flow rate control valve (path switching means)
31-34 inlet port
35 outlet port
40 electric water pump
50 radiator
61 cylinder head cooling water passage
62 cylinder block cooling water passage
71 first cooling water pipe
72 second cooling water pipe
73 third cooling water pipe
74 fourth cooling water pipe
75 fifth cooling water pipe
76 sixth cooling water pipe
77 seventh cooling water pipe
78 eighth cooling water pipe
82 first temperature sensor
82 second temperature sensor
91 heater core
92 EGR cooler
93 EGR control valve
94 throttle valve
95 thermostat
100 control device (control means)

The invention claimed is:

1. A cooling device for an internal combustion engine of a vehicle, comprising:

an electric water pump for circulating cooling water;

a first path including a cooling water passage in a cylinder head and extending through a heater core for vehicle air heating and a radiator;

a second path bypassing the heater core and the radiator;

a control valve configured to control an opening area of the second path; and a microcomputer which, when the internal combustion engine is automatically stopped while the vehicle is stopping, is configured to cause the electric water pump to operate and to cause the control valve to reduce the opening area of the second path as compared to before the internal combustion engine is automatically stopped, wherein the second path extends through a heat exchanger for oil of the internal combustion engine or a heat exchanger for oil of a powertrain for the internal combustion engine, and when the internal combustion engine is automatically stopped, the microcomputer is configured to reduce the opening area of the second path such that the lower a temperature of at least one of oil of the internal combustion engine or oil of the powertrain, the greater a reduction amount of the opening area of the second path.

2. The cooling device for the internal combustion engine of the vehicle according to claim 1, wherein the microcomputer is configured to reduce a rotation speed of the electric water pump in accordance with a decrease in a temperature of the cooling water after the internal combustion engine is automatically stopped.

3. The cooling device for the internal combustion engine of the vehicle according to claim 2, wherein, after the temperature of the cooling water has been reduced to a predetermined temperature after the internal combustion engine is automatically stopped, the microcomputer is configured to maintain the electric water pump to operate at a predetermined lowest rotation speed.

4. The cooling device for the internal combustion engine of the vehicle according to claim 1, wherein when the temperature of the cooling water has been reduced to a predetermined temperature after the internal combustion engine is automatically stopped, the microcomputer is configured to increase the opening area of the second path.

5. The cooling device for the internal combustion engine of the vehicle according to claim 1, wherein the microcomputer is configured to increase the opening area of the second path after the temperature of the oil has reached a predetermined temperature after restart of the internal combustion engine.

6. The cooling device for the internal combustion engine of the vehicle according to claim 1, wherein the microcomputer is configured to increase the opening area of the second path after a predetermined delay time has elapsed since restart of the internal combustion engine.

7. The cooling device for the internal combustion engine of the vehicle according to claim 1, wherein the first path includes a radiator line including the cooling water passage in the cylinder head and extending through the radiator; and a heater line including the cooling water passage in the cylinder head, extending through the heater core and bypassing the radiator, the second path includes a powertrain line including the cooling water passage in the cylinder head, extending through the heat exchanger for the oil of the powertrain and bypassing the radiator, and when the internal combustion engine is automatically stopped while the vehicle is stopping, the microcomputer is configured to cause the electric water pump to operate and cause the control valve to reduce the opening area of the powertrain line.

8. The cooling device for the internal combustion engine of the vehicle according to claim 7, wherein in addition to the powertrain line, the second path further includes a block line including a cooling water passage in a cylinder block, extending through the heat exchanger for the oil of the internal combustion engine and bypassing the radiator, and when the internal combustion engine is automatically stopped while the vehicle is stopping, the microcomputer is configured to cause the electric water pump to operate and cause the control valve to reduce the opening areas of the powertrain line and the block line.

* * * * *